US012385178B2

(12) United States Patent
Kwak et al.

(10) Patent No.: US 12,385,178 B2
(45) Date of Patent: Aug. 12, 2025

(54) CLOTHES TREATING SYSTEM AND CONTROL METHOD THEREOF

(71) Applicant: SAMSUNG ELECTRONICS CO., LTD., Suwon-si (KR)

(72) Inventors: Eunkyeong Kwak, Suwon-si (KR); Taehyung Kim, Suwon-si (KR); Minhwan Oh, Suwon-si (KR); Sungjong Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 176 days.

(21) Appl. No.: 18/370,119

(22) Filed: Sep. 19, 2023

(65) Prior Publication Data

US 2024/0167209 A1 May 23, 2024

Related U.S. Application Data

(63) Continuation of application No. PCT/KR2023/012628, filed on Aug. 25, 2023.

(30) Foreign Application Priority Data

Nov. 22, 2022 (KR) ..... 10-2022-0157698
Jan. 19, 2023 (KR) ..... 10-2023-0008339

(51) Int. Cl.
*D06F 29/00* (2006.01)
*D06F 23/02* (2006.01)
(Continued)

(52) U.S. Cl.
CPC ..... *D06F 29/005* (2013.01); *D06F 23/02* (2013.01); *D06F 33/32* (2020.02); *D06F 34/20* (2020.02);
(Continued)

(58) Field of Classification Search
CPC ..... D06F 29/005
See application file for complete search history.

(56) References Cited

U.S. PATENT DOCUMENTS 7,904,983 B2 3/2011 Jun et al.
8,122,547 B2 2/2012 Park
(Continued)

FOREIGN PATENT DOCUMENTS

JP 4523260 8/2010
KR 10-0717458 5/2007
(Continued)

OTHER PUBLICATIONS

International Search Report dated Dec. 19, 2023 for International Application No. PCT/KR2023/012628.
(Continued)

*Primary Examiner* — Jason Y Ko
(74) *Attorney, Agent, or Firm* — STAAS & HALSEY LLP

(57) ABSTRACT

A method of controlling a clothes treating system including a first clothes treating apparatus electrically connected to a second clothes treating apparatus, the method including obtaining information about an operation course of the first clothes treating apparatus and an operation course of the second clothes treating apparatus; identifying a priority between the operation course of the first clothes treating apparatus and the operation course of the second clothes treating apparatus based on the obtained information about the operation course of the first clothes treating apparatus and the obtained information about the operation course of the second clothes treating apparatus; and changing an algorithm of the operation course of the first clothes treating apparatus or the operation course of the second clothes treating apparatus based on the identified priority between
(Continued)

the operation courses of the first clothes treating apparatus and the second clothes treating apparatus.

15 Claims, 22 Drawing Sheets

(51) Int. Cl.

| | |
|---|---|
| ***D06F 33/32*** | (2020.01) |
| ***D06F 34/20*** | (2020.01) |
| ***D06F 34/26*** | (2020.01) |
| ***D06F 34/28*** | (2020.01) |
| ***D06F 37/30*** | (2020.01) |
| ***D06F 58/02*** | (2006.01) |
| ***D06F 58/20*** | (2006.01) |
| ***D06F 58/36*** | (2020.01) |
| *D06F 103/32* | (2020.01) |
| *D06F 105/30* | (2020.01) |
| *D06F 105/46* | (2020.01) |
| *D06F 105/50* | (2020.01) |
| *D06F 105/62* | (2020.01) |

(52) U.S. Cl.

CPC ..... *D06F 34/26* (2020.02); *D06F 34/28* (2020.02); *D06F 37/304* (2013.01); *D06F 58/02* (2013.01); *D06F 58/20* (2013.01); *D06F 58/36* (2020.02); *D06F 2103/32* (2020.02); *D06F 2105/30* (2020.02); *D06F 2105/46* (2020.02); *D06F 2105/50* (2020.02); *D06F 2105/62* (2020.02)

(56) References Cited

U.S. PATENT DOCUMENTS

| | | | |
|---|---|---|---|
| 8,312,638 | B2 | 11/2012 | Park et al. |
| 10,934,653 | B2 | 3/2021 | Choi |
| 11,078,613 | B2 | 8/2021 | Bae et al. |
| 11,085,138 | B2 | 8/2021 | Bae et al. |
| 11,492,744 | B2 | 11/2022 | Kim et al. |
| 2012/0047661 | A1 | 3/2012 | Hong et al. |
| 2016/0215432 | A1 | 7/2016 | Kim |
| 2017/0167066 | A1 | 6/2017 | Underly et al. |
| 2019/0040563 | A1 | 2/2019 | Bae |
| 2020/0024784 | A1 | 1/2020 | Yoon et al. |
| 2023/0175194 | A1 | 6/2023 | Ryoo et al. |

FOREIGN PATENT DOCUMENTS

| | | | |
|---|---|---|---|
| KR | 10-2010-0120055 | | 11/2010 |
| KR | 10-1075227 | B1 | 10/2011 |
| KR | 10-1100166 | B1 | 12/2011 |
| KR | 10-1319875 | B1 | 10/2013 |
| KR | 10-2017-0087272 | A | 7/2017 |
| KR | 10-2017-0089605 | A | 8/2017 |
| KR | 10-2017-0089677 | A | 8/2017 |
| KR | 10-2017-0090648 | A | 8/2017 |
| KR | 10-2019-0024671 | | 3/2019 |
| KR | 10-2021-0104394 | | 8/2021 |
| KR | 10-2021-0114092 | A | 9/2021 |
| KR | 10-2351650 | B1 | 1/2022 |

OTHER PUBLICATIONS

Written Opinion of International Searching Authority dated Dec. 19, 2023 for International Application No. PCT/KR2023/012628.

FIG. 16

| PRIORITY | OPERATION COURSE |
|---|---|
| 1 | ENERGY SAVING COURSE |
| 2 | TIME SAVING COURSE |
| 3 | LOW NOISE COURSE |
| 4 | DELICATE CLOTHES COURSE |
| 5 | STANDARD COURSE |
| ⋮ | ⋮ |

CLOTHES TREATING SYSTEM AND CONTROL METHOD THEREOF

CROSS-REFERENCE TO RELATED APPLICATIONS

This application is a continuation application, under 35 U.S.C. § 111 (a), of International Application No. PCT/KR2023/012628, filed on Aug. 25, 2023, which claims priority under 35 U.S.C. § 119 to Korean Patent Application No. 10-2022-0157698, filed on Nov. 22, 2022 and Korean Patent Application No. 10-2023-0008339, filed on Jan. 19, 2023, in the Korean Intellectual Property Office, the disclosures of which are incorporated by reference herein in their entireties.

BACKGROUND

1. Field

The disclosure relates to a clothes treating system including a washing machine and a plurality of clothes treating apparatuses, and a method for controlling the clothes treating system.

2. Description of the Related Art

A clothes treating apparatus is an apparatus for treating and/or caring for clothes. Clothes treating apparatuses include a washing machine and a dryer.

The washing machine is an apparatus for washing laundry put into the tub through friction by stirring the laundry, water, and a detergent together with a driving force of the drum motor. Operations that are performed by the washing machine include, regardless of the kind of the washing machine, a washing operation of supplying a detergent and water into the tub in which laundry is accommodated and washing the laundry while rotating the drum, a rinsing operation of supplying water to the tub and rinsing the laundry by rotating the drum, and a dehydrating operation of discharging water from the tub and removing water of the laundry by rotating the drum.

The dryer is an apparatus for drying objects with hot and dry air. The dryer is configured to dry objects by passing hot wind through the drum while rotating the drum in which the objects are accommodated at low speed. An operation that is performed by the dryer includes a drying operation of drying objects.

For the convenience of use, a plurality of clothes treating apparatuses may be connected to each other and used.

SUMMARY

Aspects of embodiments of the disclosure will be set forth in part in the description which follows and, in part, will be apparent from the description, or may be learned by practice of the presented embodiments.

According to an embodiment of the disclosure, provided is a method of controlling a clothes treating system including a first clothes treating apparatus and a second clothes treating apparatus electrically connected to the first clothes treating apparatus, the method including obtaining information about an operation course of the first clothes treating apparatus and information about an operation course of the second clothes treating apparatus; identifying a priority between the operation course of the first clothes treating apparatus and the operation course of the second clothes treating apparatus based on the obtained information about the operation course of the first clothes treating apparatus and the obtained information about the operation course of the second clothes treating apparatus; and changing an algorithm of the operation course of the first clothes treating apparatus or an algorithm of the operation course of the second clothes treating apparatus based on the identified priority between the operation course of the first clothes treating apparatus and the operation course of the second clothes treating apparatus.

According to an embodiment of the disclosure, the changing the algorithm of the operation course of the first clothes treating apparatus or the algorithm of the operation course of the second clothes treating apparatus may include changing the algorithm of the operation course of the second clothes treating apparatus in response to identifying that the operation course of the first clothes treating apparatus has the priority over the operation course of the second clothes treating apparatus.

According to an embodiment of the disclosure, the changing the algorithm of the operation course of the first clothes treating apparatus or the algorithm of the operation course of the second clothes treating apparatus may include changing the algorithm of the operation course of the first clothes treating apparatus in response to identifying that the operation course of the second clothes treating apparatus has the priority over the operation course of the first clothes treating apparatus.

According to an embodiment of the disclosure, the identifying the priority between the operation course of the first clothes treating apparatus and the operation course of the second clothes treating apparatus may include identifying the priority between the operation course of the first clothes treating apparatus and the operation course of the second clothes treating apparatus based on a lookup table in which priorities of a plurality of operation courses capable of being performed by the first clothes treating apparatus and the second clothes treating apparatus are mapped.

According to an embodiment of the disclosure, the first clothes treating apparatus is a washing machine may include a drum, and a drum motor to rotate the drum, and the second clothes treating apparatus is a dryer may include at least one of a compressor, and a fan and a fan motor to rotate the fan.

According to an embodiment of the disclosure, the changing the algorithm of the operation course of the first clothes treating apparatus may include changing a target revolutions per minute (RPM) of the drum motor, corresponding to the operation course of the first clothes treating apparatus, to prevent the target RPM of the drum motor and a target RPM of the fan motor, corresponding to the operation course of the second clothes treating apparatus, from being in an integer multiple relationship.

According to an embodiment of the disclosure, the changing the algorithm of the operation course of the first clothes treating apparatus may include changing a target revolutions per minute (RPM) of the drum motor, corresponding to the operation course of the first clothes treating apparatus, to prevent the target RPM of the drum motor and a target RPM of the compressor, corresponding to the operation course of the second clothes treating apparatus, from being in an integer multiple relationship.

According to an embodiment of the disclosure, the changing the algorithm of the operation course of the second clothes treating apparatus may include changing a target revolutions per minute (RPM) of the fan motor, corresponding to the operation course of the second clothes treating apparatus, to prevent a target RPM of the drum motor, corresponding to the operation course of the first clothes treating apparatus, and the target RPM of the fan motor from being in an integer multiple relationship.

According to an embodiment of the disclosure, the changing the algorithm of the operation course of the second clothes treating apparatus may include changing a target revolutions per minute (RPM) of the compressor, corresponding to the operation course of the second clothes treating apparatus, to prevent a target RPM of the drum motor, corresponding to the operation course of the first clothes treating apparatus, and the target RPM of the compressor from being in an integer multiple relationship.

According to an embodiment of the disclosure, the method may further include obtaining an inside temperature of the dryer. The changing the target RPM of the compressor may include up-regulating the target RPM of the compressor in response to the obtained inside temperature of the dryer being lower than a target temperature, and down-regulating the target RPM of the compressor in response to the obtained inside temperature of the dryer being higher than the target temperature.

According to an embodiment of the disclosure, the method may further include obtaining a vibration value of the clothes treating system; and stopping the operation course of the second clothes treating apparatus in response to the obtained vibration value of the clothes treating system being greater than a preset value.

According to an embodiment of the disclosure, the method may further include resuming the operation course of the second clothes treating apparatus in response to the operation course of the first clothes treating apparatus being completed.

According to an embodiment of the disclosure, the method may further include changing a target revolutions per minute (RPM) of the compressor or a target RPM of the fan motor in response to the operation course of the first clothes treating apparatus and the operation course of the second clothes treating apparatus having the same priority.

According to an embodiment of the disclosure, the method may further include obtaining a revolutions per minute (RPM) of the drum motor corresponding to the operation course of the first clothes treating apparatus; changing, while the operation course of the first clothes treating apparatus and the operation course of the second clothes treating apparatus having the same priority, a target revolutions per minute (RPM) of the compressor or a target RPM of the fan motor according to the obtained RPM of the drum motor being greater than a preset value; and changing, while the operation course of the first clothes treating apparatus and the operation course of the second clothes treating apparatus having the same priority, a target RPM of the drum motor according to the obtained RPM of the drum motor being smaller than the preset value.

According to an embodiment of the disclosure, a clothes treating system including a first clothes treating apparatus including a drum, a drum motor configured to rotate the drum, and a first controller configured to control the drum motor; a second clothes treating apparatus including a fan, a fan motor configured to rotate the fan, a compressor, and a second controller configured to control the fan motor and the compressor; and a user interface device configured to receive a user input selecting an operation course of the first clothes treating apparatus and an operation course of the second clothes treating apparatus. The first controller is configured to change an algorithm of the operation course of the first clothes treating apparatus based on a priority between the operation course of the first clothes treating apparatus and the operation course of the second clothes treating apparatus. The second controller is configured to change an algorithm of the operation course of the second clothes treating apparatus based on the priority between the operation course of the first clothes treating apparatus and the operation course of the second clothes treating apparatus.

BRIEF DESCRIPTION OF THE DRAWINGS

These and/or other embodiments of the disclosure will become apparent and more readily appreciated from the following description of embodiments, taken in conjunction with the accompanying drawings of which:

FIG. 16 is a lookup table showing an example of priorities for operation courses of a clothes treating system according to an embodiment of the disclosure;

DETAILED DESCRIPTION

Figure 1:
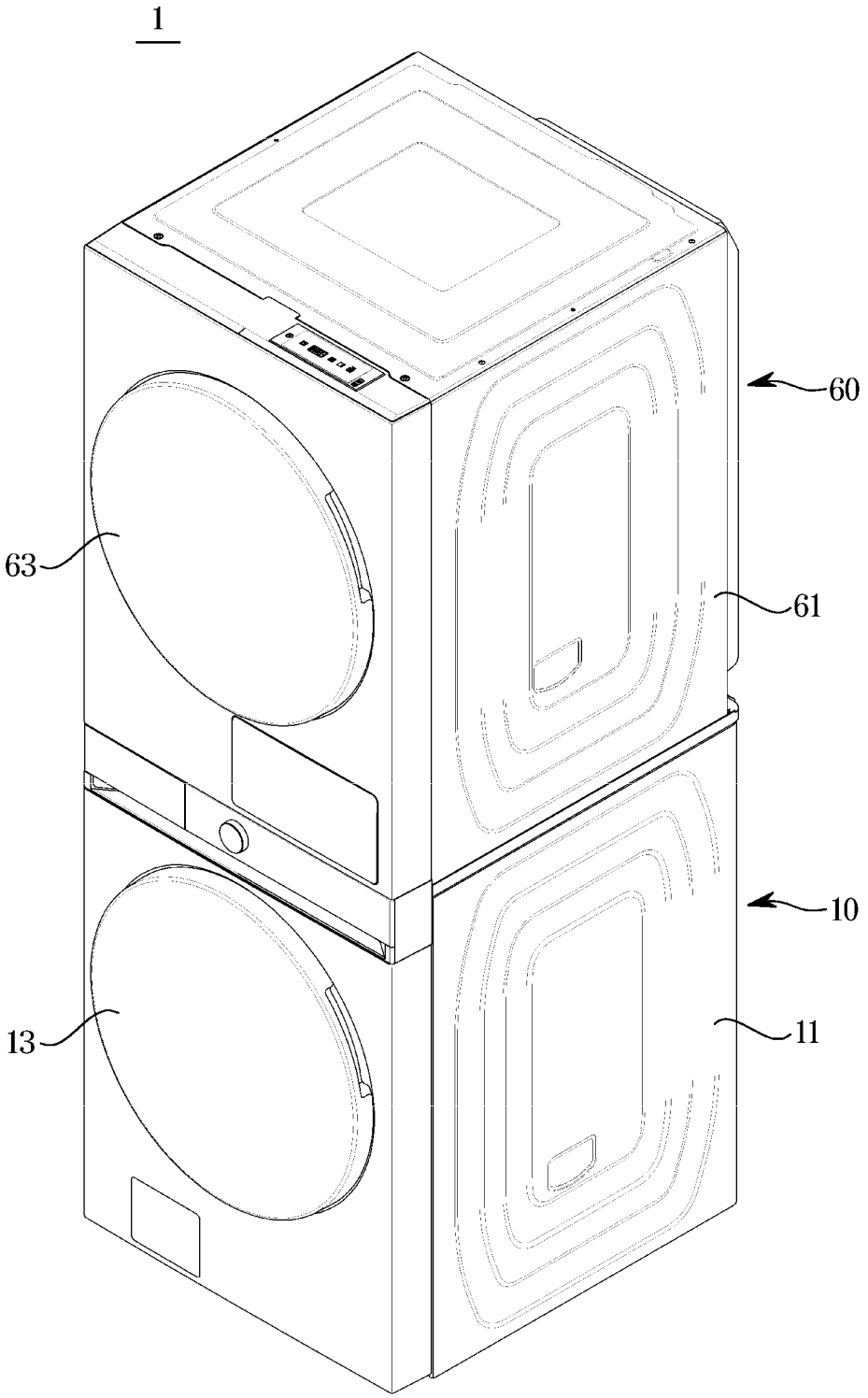
FIG. 1 shows a clothes treating system according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, the terms used in the present specification are merely used to describe the embodiments, and are not intended to limit and/or restrict the disclosure.

For example, it is to be understood that the singular forms "a," "an," and "the" include plural referents unless the context clearly dictates otherwise.

As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases.

The term "and/or" includes any and all combinations of one or more of associated listed items.

As used herein, such terms as "first" and "second" may be used to simply distinguish a corresponding component from another, and does not limit the components in other aspect (for example, importance or order).

It is to be understood that if a certain component (for example, a first component) is referred to, with or without the term "operatively" or "communicatively", as "coupled with," "coupled to," "connected with," or "connected to" another component (for example, a second component), it means that the component may be coupled with the other component directly (for example, wiredly), wirelessly, or via a third component.

It is to be understood that the terms such as "including" or "having," etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

It is to be understood that if a certain component is referred to as being "coupled with," "coupled to," "supported on" or "in contact with" another component, it means that the component may be coupled with the other component directly or indirectly via a third component.

It will also be understood that when a certain component is referred to as being "on" or "over" another component, it can be directly on the other component or intervening components may also be present.

In addition, the terms "portion", "device", "block", "member", and "module" used herein refer to a unit for processing at least one function or operation. For example, the terms may mean at least one process that may be processed by at least one hardware such as field-programmable gate array (FPGA) or application specific integrated circuit (ASIC), or at least one software or processor stored in a memory.

A washing machine according to various embodiments of the disclosure may perform a washing operation, a rinsing operation, a dehydrating operation, and a drying operation. The washing machine is an example of a clothes treating apparatus, and may be a concept including an apparatus for washing clothes (an object to be washed or an object to be dried), an apparatus for drying clothes, and an apparatus capable of performing both washing and drying.

The washing machine according to various embodiments of the disclosure may include a top-loading washing machine, wherein an inlet through which laundry is put into or taken out of the top-loading washing machine opens upward, or a front-loading washing machine, wherein a laundry inlet opens in a front direction. The washing machine according to various embodiments of the disclosure may include another loading type of washing machine other than the top-loading washing machine and the front-loading washing machine.

The top-loading washing machine may wash laundry with water streams generated by a rotating body such as a pulsator. The front-loading washing machine may wash laundry by rotating a drum to repeatedly raise and drop the laundry. The front-loading washing machine may include a washing machine with a drying function, which is capable of drying laundry accommodated in a drum. The washing machine with the drying function may include a hot air supply for supplying hot air into the drum and a condenser for removing moisture of air discharged from the drum. For example, the washing machine with the drying function may include a heat pump. The washing machine according to various embodiments of the disclosure may include a washing machine using another washing method other than the above-described washing methods.

Embodiments of the disclosure may provide a clothes treating system capable of reducing vibrations that are generated by operations of a plurality of clothes treating apparatuses.

Embodiments of the disclosure may provide a clothes treating system with improved stability.

Embodiments of the disclosure may provide a clothes treating system capable of reducing vibrations that may be generated, while satisfying a user's requirement.

Embodiments of the disclosure are not limited to the various aspects mentioned above, and other aspects not mentioned will be clearly understood by those of ordinary skill in the technical art to which the disclosure belongs from the following description.

Hereinafter, a clothes treating system according to various embodiments of the disclosure will be described in detail with reference to the accompanying drawings.

Figure 2:
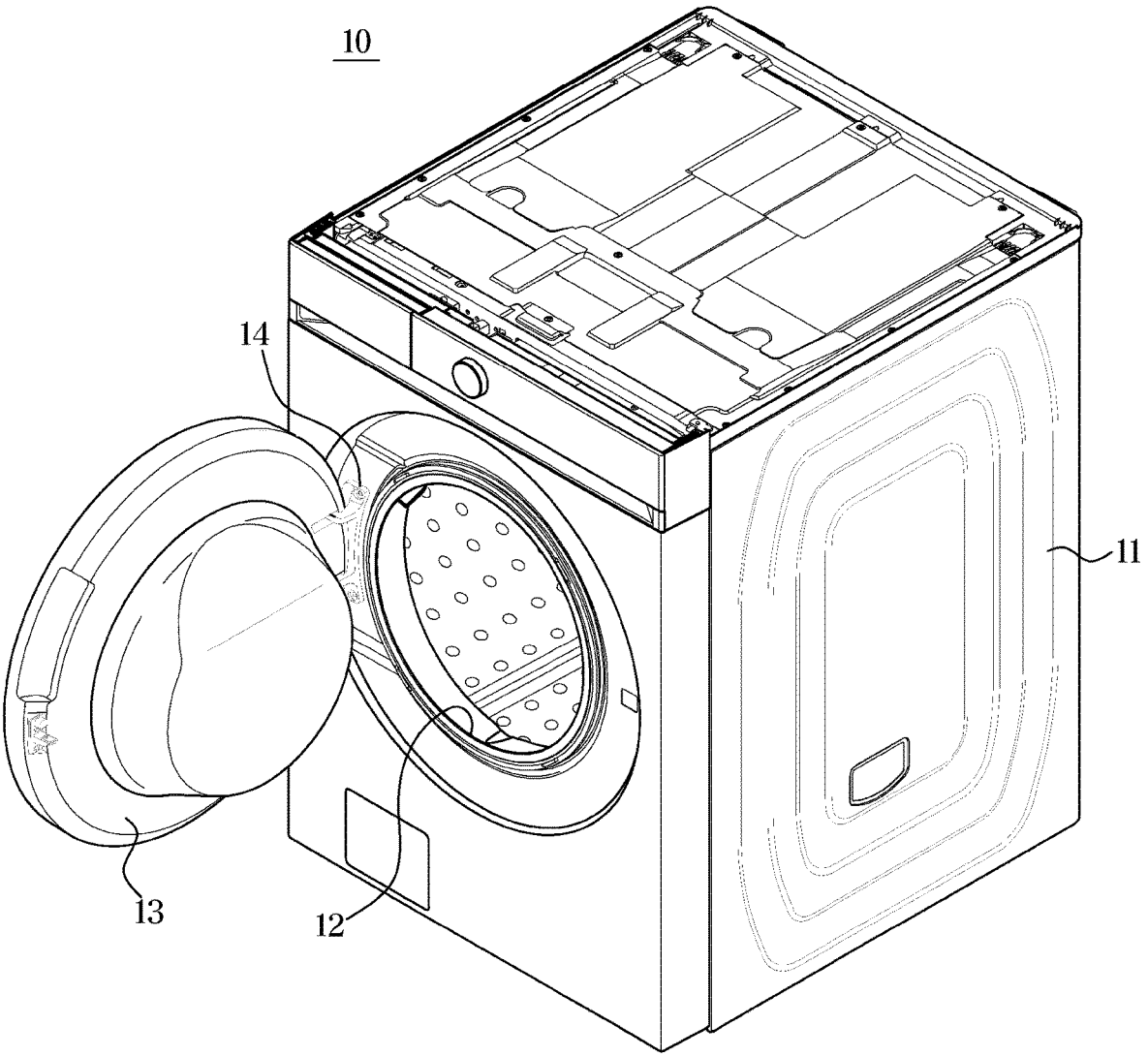
FIG. 2 shows a first clothes treating apparatus of a clothes treating system according to an embodiment of the disclosure.
Figure 3:
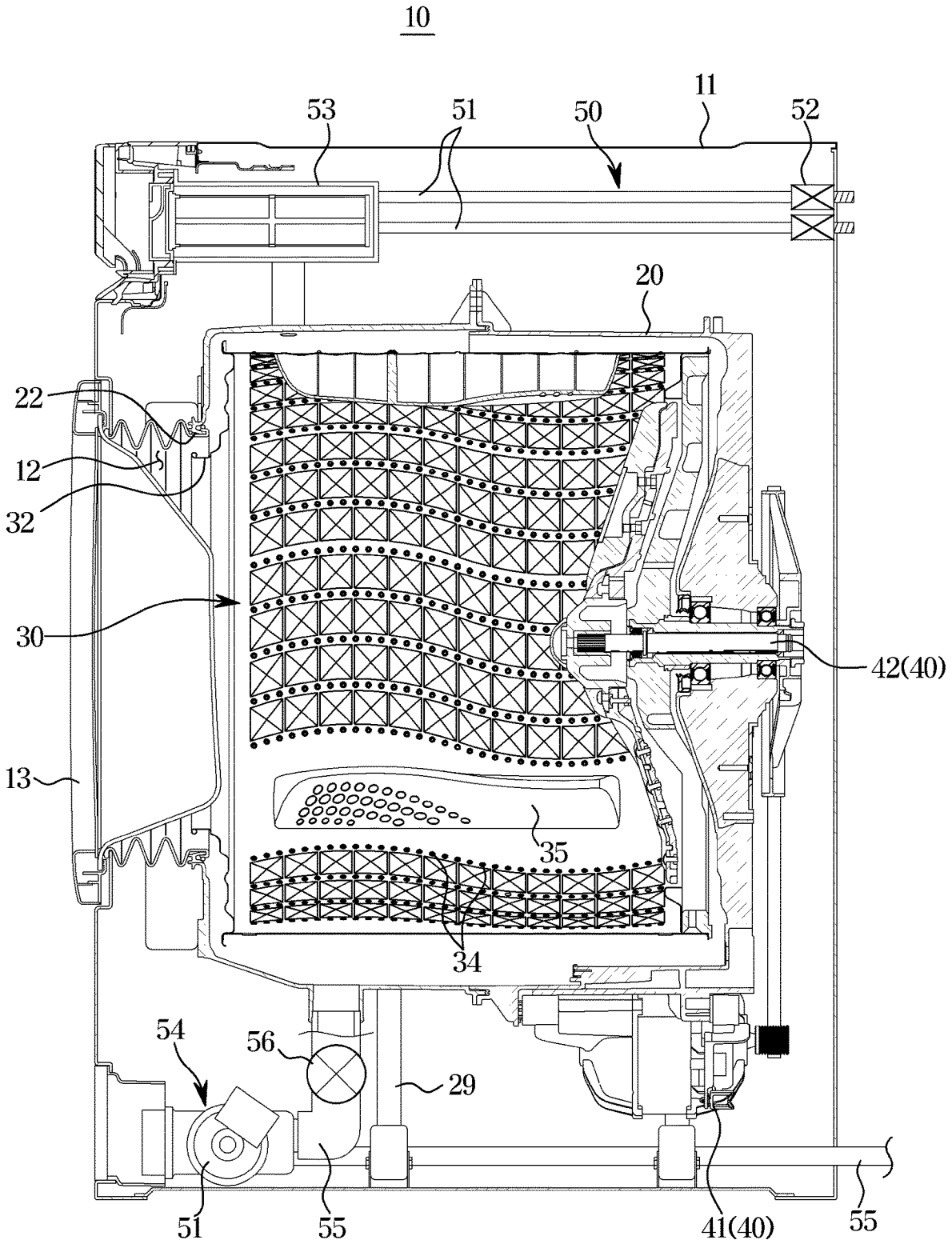
FIG. 3 shows a cross section of a first clothes treating apparatus of a clothes treating system according to an embodiment of the disclosure.
Figure 4:
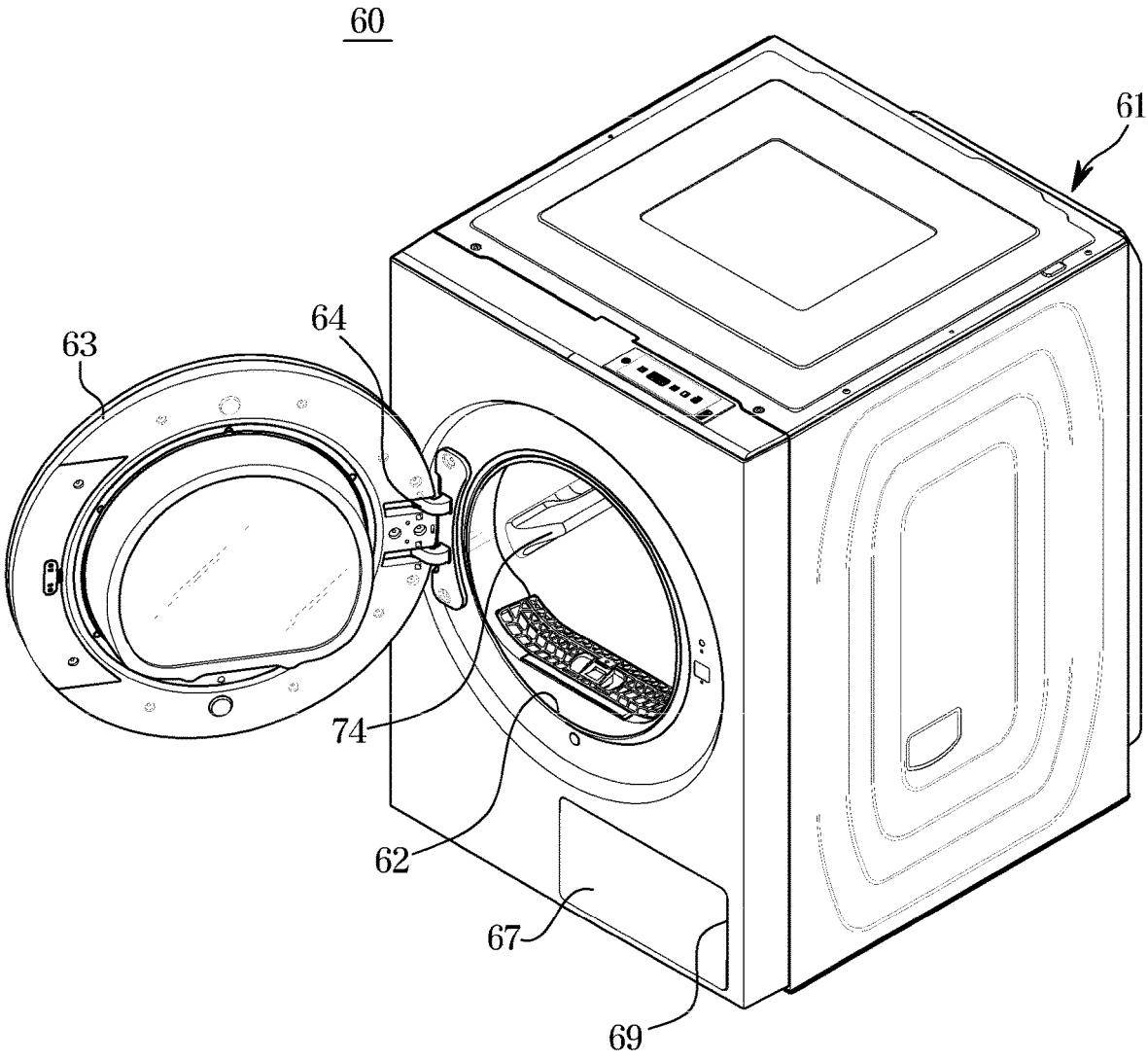
FIG. 4 shows a second clothes treating apparatus of a clothes treating system according to an embodiment of the disclosure.
Figure 5:
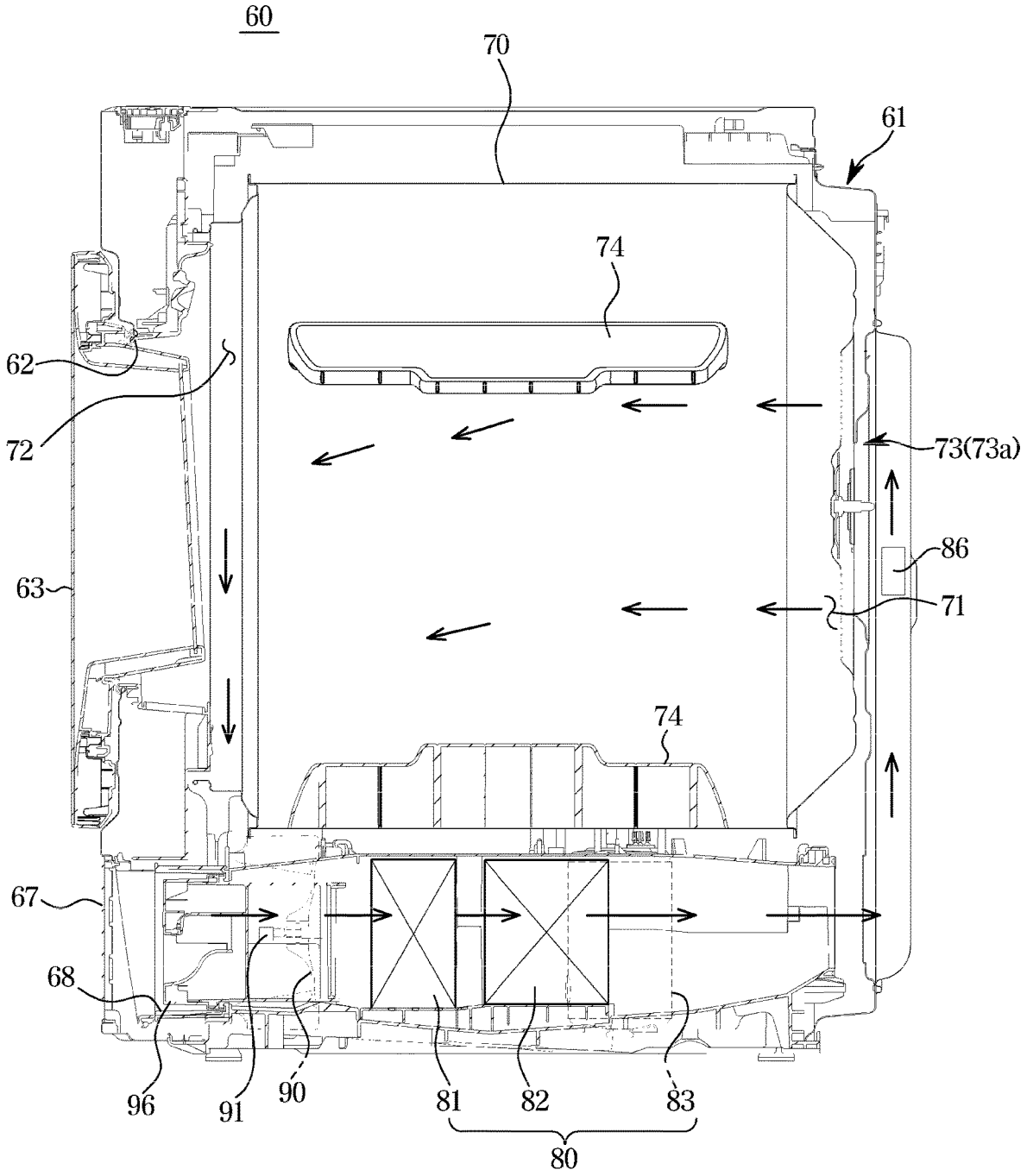
FIG. 5 shows a cross section of a second clothes treating apparatus of a clothes treating system according to an embodiment of the disclosure.

FIG. 1 shows a clothes treating system according to an embodiment of the disclosure. FIG. 2 shows a first clothes treating apparatus of a clothes treating system according to an embodiment of the disclosure. FIG. 3 shows a cross section of a first clothes treating apparatus according to an embodiment of the disclosure. FIG. 4 shows a second clothes treating apparatus of a clothes treating system according to an embodiment of the disclosure. FIG. 5 shows a cross section of a second clothes treating apparatus according to an embodiment of the disclosure.

As shown in FIG. 1, a clothes treating system 1 may include a first clothes treating apparatus 10, and a second clothes treating apparatus 60 mounted on the first clothes treating apparatus 10. For example, the second clothes treating apparatus 60 may be mounted on the first clothes treating apparatus 10.

The first clothes treating apparatus 10 may be a washing machine or a dryer. For example, the first clothes treating apparatus 10 may be a washing machine.

Referring to FIGS. 2 and 3, the first clothes treating apparatus 10 according to various embodiments of the disclosure may include a first housing 11 accommodating various components therein. The first housing 11 may be in a shape of a box, wherein a laundry inlet 12 is formed at one side of the first housing 11.

The first clothes treating apparatus 10 may include a first door 13 for opening or closing the laundry inlet 12. The first door 13 may be rotatably mounted on the first housing 11 by a first hinge 14. At least one portion of the first door 13 may be transparent or translucent to show inside of the first housing 11.

The first clothes treating apparatus 10 may include a tub 20 provided inside the first housing 11 to store water. The tub 20 may be substantially in a shape of a cylinder, wherein a tub opening 22 is formed at one side of the tub 20, and the tub 20 may be positioned inside the first housing 11 such that the tub opening 22 is positioned to correspond to the laundry inlet 12.

The tub 20 may be connected to the first housing 11 by a damper 29. The damper 29 may absorb vibrations generated according to rotations of a first drum 30 to attenuate vibrations that are transferred to the first housing 11.

The first clothes treating apparatus 10 may include the first drum 30 accommodating laundry.

The first drum 30 may be positioned inside the tub 20 such that a first drum opening 32 provided at one side of the first drum 30 corresponds to the laundry inlet 12 and the tub opening 22. Laundry may pass through the laundry inlet 12, the tub opening 22, and the first drum opening 32 sequentially to be accommodated in the first drum 30 or taken out of the first drum 30.

The first drum 30 may perform operations according to a washing operation, a rinsing operation, and/or a dehydrating operation, while rotating inside the tub 20. A plurality of through holes 34 may be formed in a cylindrical wall of the first drum 30 such that water stored in the tub 20 enters the inside of the first drum 30 or is discharged out of the first drum 30. At least one first lifter 35 may be installed on an inner circumferential surface of the first drum 30 to raise and drop laundry while the first drum 30 rotates.

The first clothes treating apparatus 10 may include a first driver 40 for rotating the first drum 30. The first driver 40 may include a first drum motor 41, and a first rotating shaft 42 for transferring a driving force generated in the first drum motor 41 to the first drum 30. The first rotating shaft 42 may be connected to the first drum 30 by penetrating the tub 20.

The first driver 40 may perform operations according to a washing operation, a rinsing operation and/or a dehydrating operation, or a drying operation by rotating the first drum 30 forward or backward.

The first clothes treating apparatus 10 may include a water supply 50 for supplying water to the tub 20. The water supply 50 may include a water supply tube 51, and a water supply valve 52 provided in the water supply tube 51. The water supply tube 51 may be connected to an external water supply source. The water supply tube 51 may extend to a detergent supply device 53 and/or the tub 20 from the external water supply source. Water may be supplied to the tub 20 via the detergent supply device 53. Water may be supplied to the tub 20 not via the detergent supply device 53.

The water supply valve 52 may open or close the water supply tube 51 in response to an electrical signal from a controller. The water supply valve 52 may allow or block supply of water from the external water supply source to the tub 20.

The water supply valve 52 may include, for example, a solenoid valve that is opened or closed in response to an electrical signal.

The first clothes treating apparatus 10 may include the detergent supply device 53 configured to supply a detergent to the tub 20. The detergent supply device 53 may include a manual detergent supply device into which a user needs to put a detergent to be used whenever performing washing, and an automatic detergent supply device which stores a large amount of detergent and automatically puts a preset amount of detergent upon washing. The detergent supply device 53 may include a detergent case for storing a detergent. The detergent supply device 53 may supply a detergent into the inside of the tub 20 while water is supplied. Water supplied through the water supply tube 51 may be mixed with a detergent via the detergent supply device 53. The water mixed with the detergent may be supplied to the inside of the tub 20. The detergent may include a detergent for pre-washing, a detergent for main washing, a fabric softener, bleach, etc., and the detergent case may be partitioned into a pre-washing detergent storage area, a main washing detergent storage area, a fabric softener storage area, and a bleach storage area.

The first clothes treating apparatus 10 may include a drain device 54 for discharging water accommodated in the tub 20 to outside. The drain device 54 may include a drain tube 55 extending from a lower portion of the tub 20 to outside of the first housing 11, a drain valve 56 provided at the drain tube 55 and configured to open or close the drain tube 55, and a drain pump 57 provided on the drain tube 55. The drain pump 57 may pump water of the drain tube 55 to the outside of the first housing 11.

According to various embodiments of the disclosure, the first clothes treating apparatus 10 may further include a heater (not shown) for heating water stored in the tub 20.

According to various embodiments of the disclosure, the first clothes treating apparatus 10 may further include a heater (not shown) for heating water supplied through the water supply 50.

The second clothes treating apparatus 60 may be a washing machine or a dryer. For example, the second clothes treating apparatus 60 may be a dryer.

Referring to FIGS. 4 and 5, the second clothes treating apparatus 60 according to various embodiments of the disclosure may include a second housing 61 accommodating various components therein. The second housing 61 may be in a shape of a box, wherein an object inlet 62 is formed at one side of the second housing 61.

The second clothes treating apparatus 60 may include a second door 63 for opening or closing the object inlet 62. The second door 63 may be rotatably mounted on the second housing 61 by a second hinge 64. At least one portion of the second door 63 may be transparent or translucent to show inside of the second housing 61.

The second clothes treating apparatus 60 may include a second drum 70 that accommodates an object. The second drum 70 may be positioned inside the second housing 61 such that a second drum opening 72 provided at one side of the second drum 70 corresponds to the object inlet 62. An object may pass through the object inlet 62 and the second drum opening 72 sequentially to be accommodated inside the second drum 70 or taken out of the second drum 70. The second drum 70 may be rotatably provided inside the second housing 61.

The second clothes treating apparatus 60 may include a second driver 73 configured to rotate the second drum 70. The second driver 73 may include a second drum motor 73*a*, and a second rotating shaft (not shown) for transferring a driving force generated in the second drum motor 73*a* to the second drum 70.

The second drum 70 may include an inlet 71 through which air enters inside of the second drum 70. Inside air of the second drum 70 may be discharged to the outside of the second drum 70 through the second drum opening 72. The inlet 71 may be positioned at another side of the second drum 70, the other side being opposite to the one side at which the second drum opening 72 is positioned. For example, the inlet 71 may be positioned in a rear portion of the second drum 70, and the second drum opening 72 may be positioned in a front portion of the second drum 70.

Hot and dry air may enter the second drum 70 through the inlet 71 to dry an object accommodated in the second drum 70. Air containing a large amount of moisture after drying the object may be discharged from the second drum 70 through the second drum opening 72.

At least one second lifter 74 may be provided inside the second drum 70. The second lifter 74 may raise and drop an object to cause the object to be in contact with hot air while floating in an inside space of the second drum 70.

A heat pump 80 for heating and condensing air may be formed inside the second housing 61. A refrigerant of the heat pump 80 may circulate through a series of processes of compression-condensation-expansion-evaporation. More specifically, the heat pump 80 may include an evaporator 81, a condenser 82, a compressor 83, and an expander.

The compressor 83 may compress a refrigerant into a high-temperature, high-pressure state and then discharge the refrigerant, and the discharged refrigerant may enter the condenser 82. The condenser 82 may condense the compressed refrigerant and emit heat to surroundings through the condensation. Also, the expander may expand the refrigerant being in a high-temperature, high-pressure state and condensed in the condenser 82, to a low-pressure state. The evaporator 81 may evaporate the expanded refrigerant and take away heat from surroundings through the evaporation.

As operation revolutions per minute (RPM) of the compressor 83 increases, an amount of heat that is emitted to the surroundings through a condensation process of the condenser 82 may increase.

While an object is put into the second clothes treating apparatus 60 and the second clothes treating apparatus 60 operates in a drying mode, hot and humid air discharged from the second drum 70 may pass through the evaporator 81. Accordingly, the hot and humid air discharged from the second drum 70 may be cooled by passing through the evaporator 81 and change to cold and dry air. At this time, while the hot and humid air is cooled in the evaporator 81, condensation water may be generated. The condensation water may move to a collection bucket or be drained to the outside of the second housing 61. Also, the cold and dry air passed through the evaporator 81 may pass through the condenser 82. Accordingly, the cold and dry air discharged from the evaporator 81 may be heated by passing through the condenser 82 and change to hot and dry air. The hot and dry air may enter the second drum 70 through the inlet 71 to dry the object. Hot and humid air containing a large amount of moisture by drying the object may be discharged through the second drum opening 72. The discharged air may again pass through the evaporator 81. In summary, air may dry an object accommodated in the second drum 70 while circulating the inside of the second housing 61.

In the drying mode, a closed flow path may be formed inside the second housing 61 of the second clothes treating apparatus 60. The closed flow path may be a movement path (see an arrow of FIG. 5) of air along which inside air of the second housing 61 circulates the heat pump 80 and the second drum 70. The closed flow path may not communicate with the outside of the second housing 61 such that outside air of the second housing 61 does not enter the second housing 61 and inside air of the second housing 61 is not discharged to the outside. That is, a flow of air may form a closed loop.

The second clothes treating apparatus 60 may include a heater 86 provided on the closed flow path. The heater 86 may be implemented through a heating coil, although not limited thereto. However, the heater 86 may be implemented through various known devices. The heater 86 may further heat air heated by passing through the condenser or the heater 86 may heat air received from the outside without being heated through the heat pump 80.

Referring to FIG. 4, the second clothes treating apparatus 60 may include a housing opening 69 provided at a front side of the second housing 61 to allow an access to the heat pump 80. More specifically, a filter device 96 may be installed inside the second housing 61 through the housing opening 69. More specifically, the filter device 96 may be detachably installed in a device accommodating portion 68 formed inside the second housing 61 through the housing opening 69. According to installation of the filter device 96 in the device accommodating portion 68, the second clothes treating apparatus 60 may perform a drying mode (drying operation) for drying an object such as clothes. Meanwhile, a housing cover 67 may be provided in a front surface of the second housing 61 to open or close the housing opening 69.

While the housing cover 67 closes the housing opening 69, a front surface of the housing cover 67 may be connected to the front surface of the second housing 61 to form a seamlessly connected surface without any step. While the filter device 96 is not installed inside the second housing 61, a user may access the heat pump 80 through the housing opening 69. Foreign materials such as lint may adhere to the heat pump 80 due to long-time use of the dryer, and a user may remove such foreign materials through the housing opening 69.

The filter device 96 may be detachably installed in the second clothes treating apparatus 60. More specifically, the filter device 96 may be detachably installed inside the second housing 61 through the housing opening 69. The filter device 96 may be installed in the device accommodating portion 68 or separated from the device accommodating portion 68.

A fan 90 may be positioned below the second drum 70. The fan 90 may circulate inside air of the second housing 61. The fan 90 may form a circulating airflow passing through the second drum 70 inside the second housing 61.

The second clothes treating apparatus 60 may include a fan motor 91 configured to rotate the fan 90.

A driving force generated in the fan motor 91 may rotate the fan 90.

According to various embodiments of the disclosure, the fan motor 91 for rotating the fan 90 may have the same configuration as the second drum motor 73*a* for rotating the second drum 70.

According to an embodiment of the disclosure, a single motor 91 and 73*a* may be connected to different rotating shafts to simultaneously rotate the fan 90 and the second drum 70.

While the single motor 91 and 73*a* is connected to the different rotating shafts to simultaneously rotate the fan 90 and the second drum 70, RPM of the fan 90 may be different from RPM of the second drum 70. For example, RPM of the fan 90 may be greater than RPM of the second drum 70.

According to various embodiments of the disclosure, the fan motor 91 for rotating the fan 90 and the second drum motor 73*a* for rotating the second drum 70 may be separate components.

Figure 6:
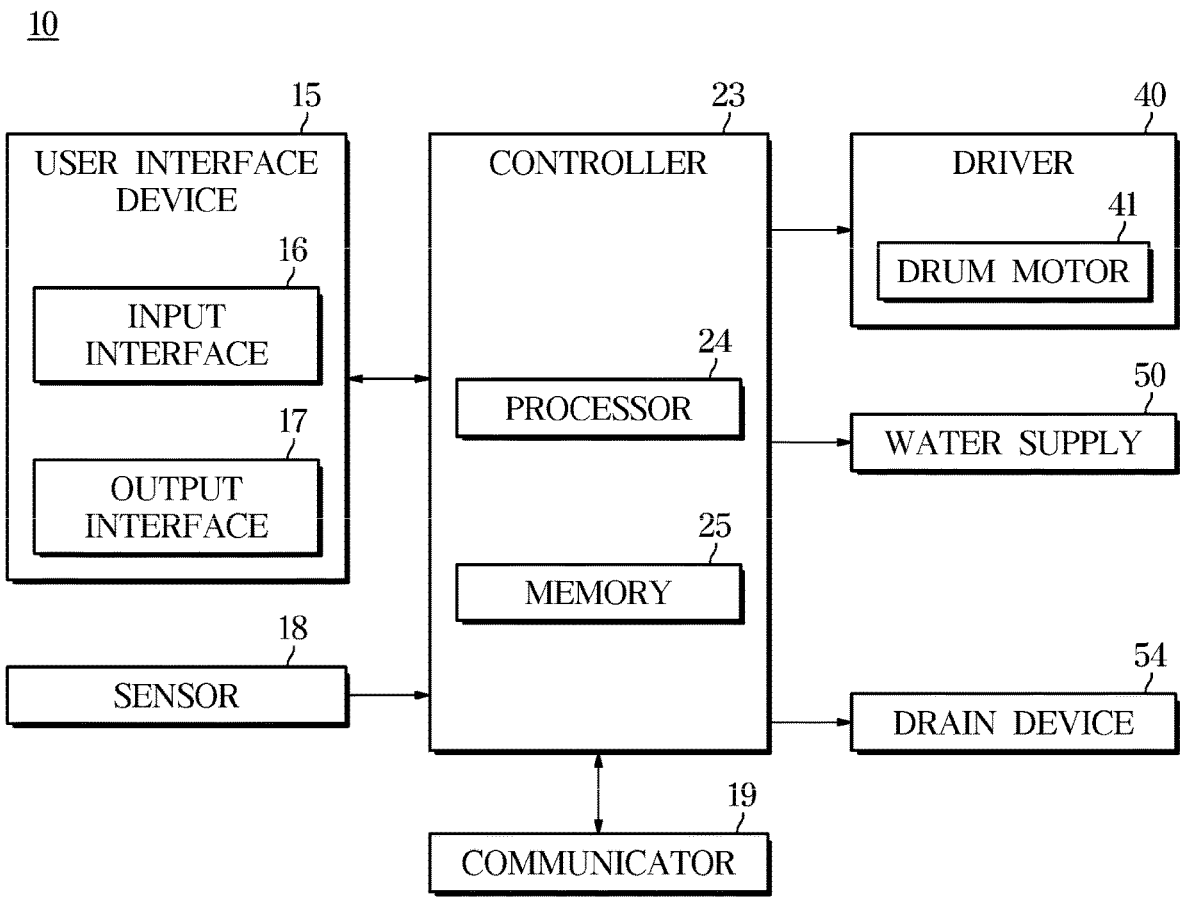
FIG. 6 is a control block diagram of a first clothes treating apparatus according to an embodiment of the disclosure.

FIG. 6 is a control block diagram of a first clothes treating apparatus according to an embodiment of the disclosure.

Referring to FIG. 6, according to an embodiment of the disclosure, the first clothes treating apparatus 10 may include a user interface device 15, the first driver 40, the water supply 50, the drain device 54, a sensor 18, a communicator 19, and a controller 23.

The user interface device 15 may provide a user interface for enabling a user to interact with the first clothes treating apparatus 10.

The user interface device 15 may include at least one input interface 16 and at least one output interface 17.

According to an embodiment of the disclosure, the user interface device 15 may be positioned at one side of the first housing 11, although a location of the user interface device 15 is not limited thereto.

The least one input interface 16 may convert sensory information received from a user into an electrical signal.

The at least one input interface 16 may include a power button, an operation button, a course selection dial (or a course selection button), and a washing/rinsing/dehydrating button. The at least one input interface 16 may include, for example, a tact switch, a push switch, a slide switch, a toggle switch, a micro switch, a touch switch, a touch pad, a touch screen, a jog dial, and/or a microphone, etc.

The at least one output interface 17 may generate sensory information and transfer various data related to an operation of the first clothes treating apparatus 10 to a user.

For example, the at least one output interface 17 may transfer information related to washing courses and operation times of the first clothes treating apparatus 10 or washing settings/rinsing settings/dehydrating settings to a user. Information related to operations of the first clothes treating apparatus 10 may be output through a screen, an indicator, a voice, etc. The at least one output interface 17 may include, for example, a Liquid Crystal Display (LCD) panel, a Light Emitting Diode (LED) panel, a speaker, etc.

The washing courses may include washing settings (for example, washing temperature, a number of times of rinsing, strength of dehydrating, etc.) set in advance by a designer of the first clothes treating apparatus 10 according to kinds (for example, bedclothes, underwear, etc.) and materials (for example, wool, etc.) of laundry. For example, standard washing may include washing settings capable of being applied to most of laundry, and bedclothes washing may include washing settings optimized to wash bedclothes. The washing courses may be divided into, for example, standard washing, strong washing, delicate clothes washing, bedclothes washing, baby clothes washing, towel washing, small washing, boiled washing, outdoor clothes washing, rinsing/dehydrating, dehydrating, etc.

According to various embodiments of the disclosure, the washing courses may include a plurality of courses according to users' needs. For example, the washing courses may include an energy saving course, a time saving course, a low noise course, etc.

The energy saving course may be a course for reducing energy that is consumed to perform a washing cycle. While the first clothes treating apparatus 10 performs a washing cycle corresponding to the energy saving course, an operation of the heater for heating water stored in the tub 20 may be reduced.

The time saving course may correspond to a course for reducing a time that is consumed to perform a washing cycle. While the first clothes treating apparatus 10 performs a washing cycle corresponding to the time saving course, a number of times of a washing operation, a rinsing operation, and/or a dehydrating operation may be reduced, or a consumption time for a washing operation, a rinsing operation, and/or a dehydrating operation may be reduced.

The low noise course may be a course for reducing noise generated from the first clothes treating apparatus 10 while a washing cycle is performed. While the first clothes treating apparatus 10 performs a washing cycle corresponding to the low noise course, maximum RPM of the first drum 30 in a washing operation, a rinsing operation, and/or a dehydrating operation may be reduced.

In the disclosure, courses, such as the energy saving course, the time saving course, and the low noise course, according to a user's special needs may be defined as specialized courses.

In the disclosure, remaining courses (for example, a standard course) except for the specialized courses may be defined as normal courses.

The memory 25 may store a plurality of washing course algorithms corresponding to a plurality of washing courses. The plurality of washing course algorithms may be algorithms for controlling a plurality of components (for example, the first driver 40, the water supply 50, the drain device 54, and/or the heater (not shown)) in a washing cycle.

The processor 24 may perform a washing course based on an algorithm of an operation course selected based on a user input from among the plurality of washing course algorithms stored in the memory 25.

The first driver 40 may include the first drum motor 41 that provides a driving force for rotating the first drum 30. The first driver 40 may operate based on a control signal from the controller 23.

The water supply 50 may include the water supply valve 52 for opening or closing the water supply tube 51 extending from the external water supply source to the detergent supply device 53 and/or the tub 20. The water supply valve 52 may be opened or closed based on a control signal from the controller 23.

The drain device 54 may include the drain pump 57 for discharging water of the tub 20 to the outside of the first housing 11. The drain pump 57 may operate based on a control signal from the controller 23.

The sensor 18 may include at least one sensor for obtaining information related to an operation state of the first clothes treating apparatus 10.

For example, the sensor 18 may include at least one among a water level sensor for detecting a water level of the tub 20, a sensor for detecting an operation state of the first driver 40, a flow sensor for detecting a rate of flow of water entered the tub 20 through the water supply 50, or a sensor for detecting an operation state of the drain device 54.

According to various embodiments of the disclosure, the sensor 18 may include at least one sensor for detecting a weight of laundry accommodated in the first drum 30.

According to various embodiments of the disclosure, the sensor 18 may include a vibration sensor for detecting a vibration value of the tub 20. The vibration sensor may detect vibrations of the tub 20. More specifically, the vibration sensor may detect vibrations of the tub 20, which are generated by a rotation of the first drum 30 while a washing cycle is performed (for example, during a dehydrating operation). Due to unbalance of laundry positioned inside the first drum 30, eccentricity of the first drum 30 may occur, and due to the eccentricity of the first drum 30, vibrations of the tub 20 may be generated. As a result of an increase of RPM of the first drum 30 while laundry is positioned unbalanced, vibrations of the tub 20 may increase, and noise may also increase by the vibrations of the tub 20.

According to various embodiments of the disclosure, while the first clothes treating apparatus 10 and the second clothes treating apparatus 60 operate together, vibrations of the tub 20 may increase by frequency resonance.

The vibration sensor may output a vibration signal related to vibrations of the tub 20. An amplitude of the vibration signal may be defined as a vibration value corresponding to the vibrations of the tub 20.

According to an embodiment of the disclosure, the controller 23 may convert a vibration signal of a time domain, output from the vibration sensor, into a vibration signal of a frequency domain, and process the vibration signal of the frequency domain. The vibration sensor may include a six-axes sensor capable of detecting displacement of six axes (X, Y, Z, Pitch, Roll, and Yaw).

The sensor for detecting the operation state of the first driver 40 may include, for example, a current sensor for measuring driving current that is applied to the first drum motor 41, although not limited thereto.

The sensor for detecting the operation state of the drain device 54 may include, for example, a current sensor for measuring driving current that is applied to the drain pump 57, although not limited thereto.

The first clothes treating apparatus 10 may include the communicator 19 for communicating with an external device (for example, a server, a user device, and/or another home appliance) in a wired and/or wireless manner.

The user device and/or the other home appliance may include various electronic devices, such as a smart phone, a notebook, a laptop, a smart watch, an internet of things (IoT) hub device, another home appliance (for example, a television and/or the second clothes treating apparatus 60), a stationary type tablet, and a speaker.

The communicator 19 may include a short-range communication module and/or a long-distance communication module.

The communicator 19 may transmit data to an external device or receive data from the external device. For example, the communicator 19 may establish communication with a server, a user device, and/or another home appliance, and transmit/receive various data to/from the server, the user device, and/or the other home appliance.

For this, the communicator 19 may support establishment of a direct (for example, wired) communication channel or a wireless communication channel with an external device, and communications through an established communication channel. According to an embodiment of the disclosure, the communicator 19 may include a wireless communication module (for example, a cellular communication module, a short-range wireless communication module, or a global navigation satellite system (GNSS) communication module) or a wired communication module (for example, a local area network (LAN) communication module or a power line communication module). A corresponding communication module among the communication modules may communicate with an external device through a first network (for example, a short-range wireless communication network, such as Bluetooth, wireless fidelity (WiFi) Direct, or Infrared data association (IrDA)) or a second network (for example, a long-distance wireless communication network, such as a legacy cellular network, a 5th Generation (5G) network, a next-generation communication network, the Internet, or a computer network (for example, a LAN or a wide area network (WAN)). The various kinds of communication modules may be integrated into a single component (for example, a single chip) or implemented with a plurality of separate components (for example, a plurality of chips).

The short-range wireless communication module may include a Bluetooth communication module, a Bluetooth Low Energy (BLE) communication module, a Near Field Communication (NFC) module, a Wireless Local Area Network (WLAN; WiFi) communication module, a Zigbee communication module, an IrDA communication module, a Wi-Fi Direct (WFD) communication module, a Ultrawideband (UWB) communication module, an Ant+ communication module, a microwave (uWave) communication module, etc., although not limited thereto.

The long-distance wireless communication module may include a communication module that performs various kinds of long-distance communications, and may include a mobile communicator. The mobile communicator may transmit/receive a wireless signal to/from at least one of a base station, an external terminal, or a server on a mobile communication network.

According to an embodiment of the disclosure, the communicator 19 may communicate with an external device, such as a server, a user device, another home appliance, etc., through a surrounding Access Point (AP). The AP may connect a LAN to which the first clothes treating apparatus 10 and/or a user device and/or another home appliance is connected to a WAN to which a server is connected. The first clothes treating apparatus 10 and/or the user device and/or the other home appliance may be connected to the server through the WAN.

The controller 23 may control various components (for example, the first driver 40, the water supply 50, and the drain device 54) of the first clothes treating apparatus 10. The controller 23 may control various components of the first clothes treating apparatus 10 to perform at least one operation including water supply, washing, rinsing, and/or dehydrating according to a user input. For example, the controller 23 may control the first driving motor 41 of the first driver 40 to regulate RPM of the first drum 30, control the water supply valve 52 of the water supply 50 to supply water to the tub 20, or control the drain pump 57 of the drain device 54 to discharge water of the tub 20 to the outside.

The controller 23 may include hardware, such as a central processing unit (CPU), a micro-computer (Micom), or a memory, and software such as a control program. For example, the controller 23 may include at least one memory 25 that stores data in a form of an algorithm or program for controlling operations of components in the first clothes treating apparatus 10, and at least one processor 24 that performs the above-described operations and operations which will be described below by using data stored in the at least one memory 25. The memory 25 and the processor 24 may be implemented as separate chips. The processor 24 may include one, two, or more processor chips or one, two, or more processing cores. The memory 25 may include one, two, or more memory chips or one, two, or more memory blocks. Also, the memory 25 and the processor 24 may be implemented as a single chip.

Figure 7:
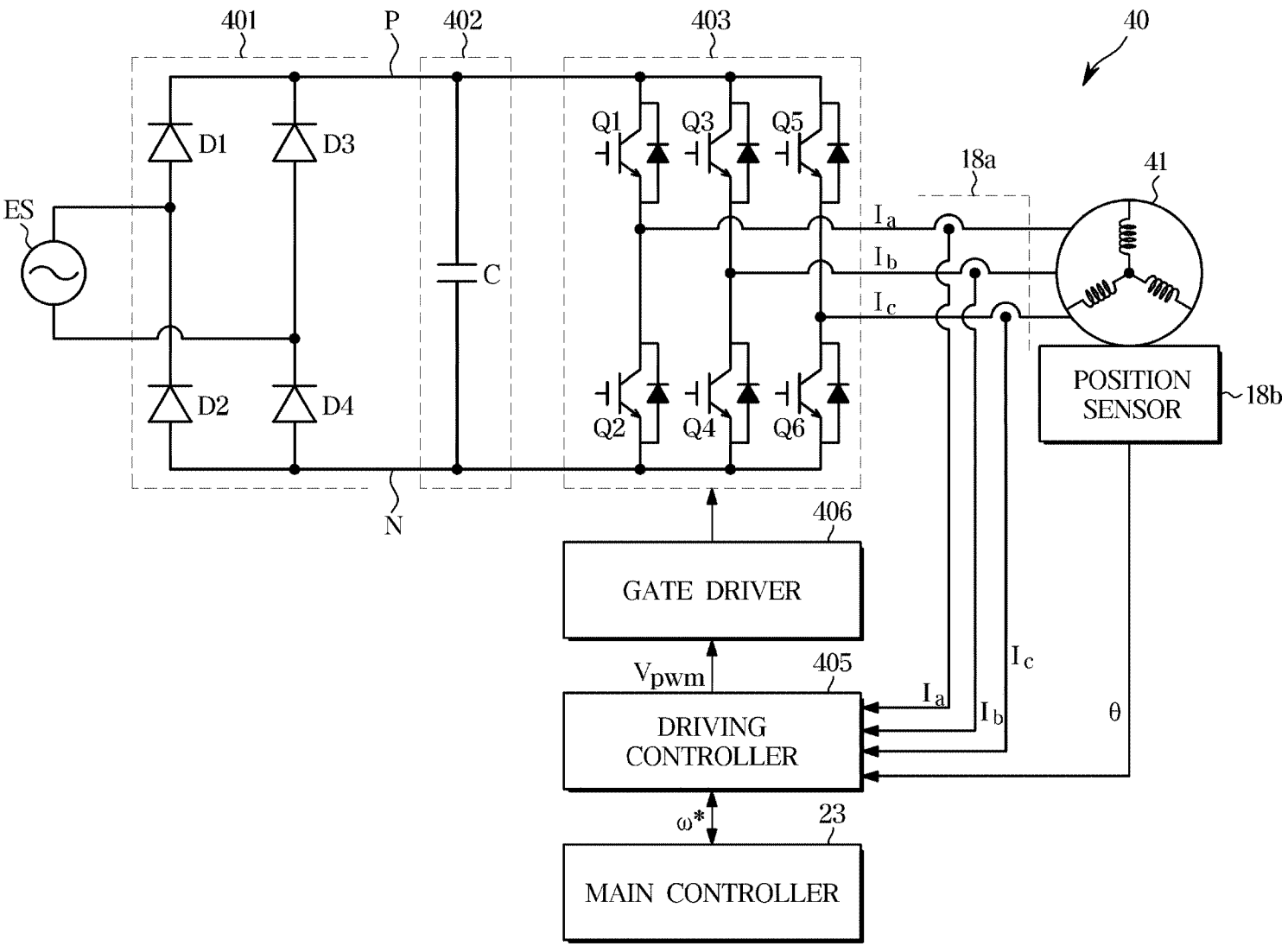
FIG. 7 shows an example of a driver included in a first clothes treating apparatus according to an embodiment of the disclosure.
Figure 8:
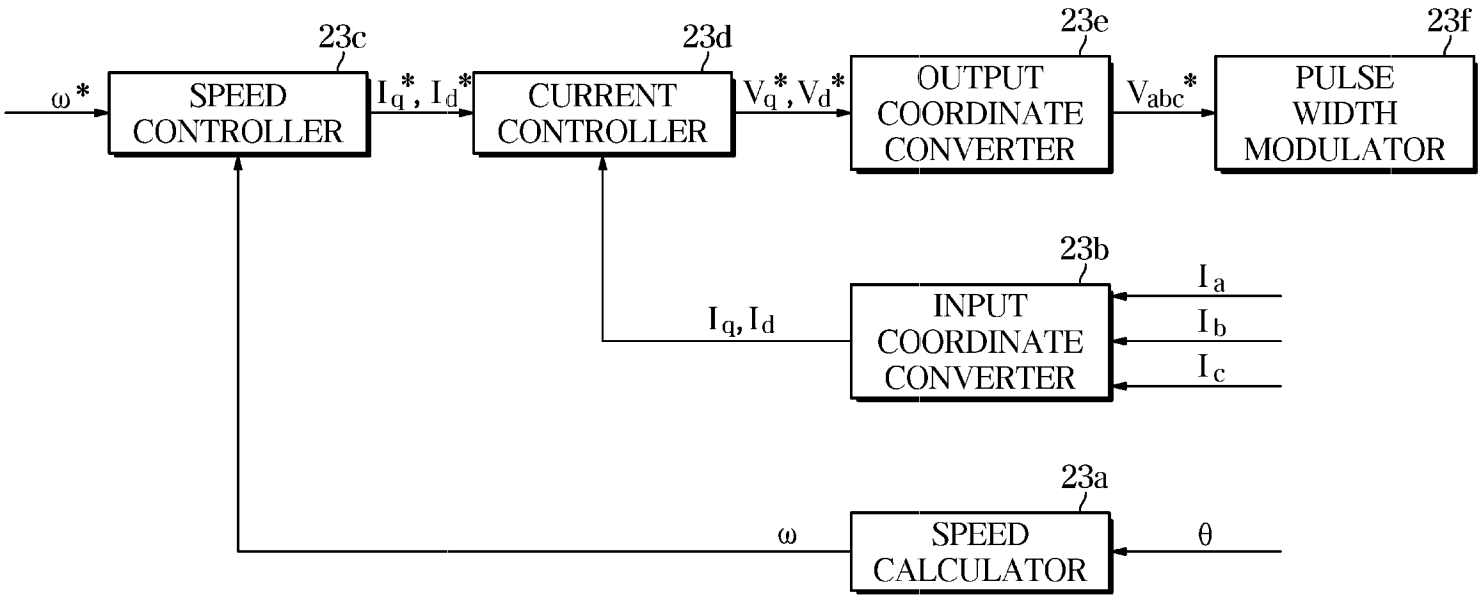
FIG. 8 shows an example of a controller included in a first clothes treating apparatus according to an embodiment of the disclosure.

FIG. 7 shows an example of a driver included in a first clothes treating apparatus according to an embodiment of the disclosure. FIG. 8 shows an example of a controller included in a first clothes treating apparatus according to an embodiment of the disclosure.

Referring to FIG. 7, the first driver 40 may include a rectifying circuit 401 for rectifying alternating current power of an external power source (ES), a direct current link circuit 402 for removing ripples of rectified power and outputting direct current power, an inverter circuit 403 for converting direct current power into driving power in a form of sine waves and outputting driving current $I_{abc}$ to the first drum motor 41, a current sensor 18*a* for measuring driving current $I_a$, $I_b$, and $I_c$ to be supplied to the first drum motor 41, a driving controller 405 for controlling driving power conversion of the inverter circuit 430, and a gate driver 406 for turning on/off switching devices Q1, Q2, Q3, Q4, Q5, and Q6 included in the inverter circuit 430 based on a driving signal from the driving controller 405.

Also, a position sensor 18*b* for measuring a position (for example, an electrical angle) of a rotor of the first drum motor 41 may be provided at the first drum motor 41.

The rectifying circuit 410 may include a diode bridge including a plurality of diodes D1, D2, D3, and D4. The diode bridge may be provided between a positive terminal P and a negative terminal N of the first driver 40. The rectifying circuit 410 may rectify alternating current power (alternating current voltage and alternating current) of which a magnitude and direction change over time to power having a constant direction.

The direct current link circuit 402 may include a direct current link capacitor C that stores electricity energy. The direct current link capacitor C may be provided between the positive terminal P and the negative terminal N of the first driver 40. The direct current link circuit 402 may receive power rectified by the rectifying circuit 410 and output direct current power having a constant magnitude and direction.

The inverter circuit 430 may include three pairs Q1 and Q2, Q3 and Q4, and Q5 and Q6 of switching devices provided between the positive terminal P and the negative terminal N of the first driver 40. More specifically, the inverter circuit 430 may include a plurality of upper switching devices Q1, Q3, and Q5 and a plurality of lower switching devices Q2, Q4, and Q6.

The pairs Q1 and Q2, Q3 and Q4, and Q5 and Q6 of switching devices may respectively include two switching devices Q1 and Q2, Q3 and Q4, and Q5 and Q6, which are connected in series to each other. Each of the switching devices Q1, Q2, Q3, Q4, Q5, and Q6 included in the inverter circuit 430 may be turned on/off according to an output from the gate driver 406, and according to turning on/off of the switching devices Q1, Q2, Q3, Q4, Q5, and Q6, three-phase driving current $I_a$, $I_b$, and $I_c$ may be supplied to the first drum motor 41.

The current sensor 18*a* may measure three-phase driving current (a-phase current, b-phase current, and c-phase current) output from the inverter circuit 430, and output data representing measured three-phase driving current values $I_a$, $I_b$, and $I_c$ ($I_{abc}$) to the driving controller 405. Also, the current sensor 18*a* may measure only two-phase driving current among the three-phase driving current $I_{abc}$, and the driving controller 405 may estimate another driving current from the two-phase driving current.

The position sensor 18*b* may be provided at the first drum motor 41, measure a position (for example, an electrical angle) 8 of the rotor of the first drum motor 41, and output position data representing the electrical angle θ of the rotor. The position sensor 18*b* may be implemented as a hall sensor, an encoder, a resolver, etc.

The gate driver 406 may output a gate signal for turning on/off the plurality of switching devices Q1, Q2, Q3, Q4, Q5, and Q6 included in the inverter circuit 430 based on an output from the driving controller 405.

The driving controller 405 may be separated from the controller 23 or integrated into the controller 23. The driving controller 405 may include, for example, an application specific integrated circuit (ASIC) that outputs a driving signal based on a RPM command ω*, driving current values $I_{abc}$, and a rotor position θ. Alternatively, the driving controller 405 may include a memory that stores a series of commands for outputting a driving signal based on a RPM command ω*, driving current values $I_{abc}$, and a rotor position θ, and a processor that processes the series of commands stored in the memory.

The driving controller 405 may be integrated into the controller 23. For example, the driving controller 405 may be implemented as a series of commands for outputting a driving signal based on a RPM command ω*, driving current values $I_{abc}$, and a rotor position θ, which are stored in the memory 25 of the controller 23.

The RPM command ω* stored in the memory 25 of the controller 23 may be selected based on an algorithm of an operation course.

The driving controller 405 may receive a motor control signal (for example, a RPM command) from the controller 230, receive driving current values $I_{abc}$ from the current sensor 18*a*, and receive a rotor position θ of the first drum motor 41 from the position sensor 18*b*. The driving controller 405 may identify a driving current value that is to be supplied to the first drum motor 41, based on the RPM command ω*, the driving current values $I_{abc}$, and the rotor position θ, and output a driving signal (PWM signal) for controlling the inverter circuit 430 according to the identified driving current value.

The driving controller 405 and/or the controller 23 may include, as shown in FIG. 8, a speed calculator 23*a*, an input coordinate converter 23*b*, a speed controller 23*c*, a current controller 23*d*, an output coordinate converter 23*e*, and a pulse width modulator 23*f*.

The speed calculator 23*a* may calculate a RPM value w of the first drum motor 41 based on a rotor electrical angle θ of the first drum motor 41. Herein, the rotor electrical angle θ may be received from the position sensor 18*b* provided at the first drum motor 41. For example, the speed calculator 23*a* may calculate a RPM value w of the first drum motor 41 based on an amount of change of the rotor electrical angle θ with respect to a sampling time interval.

According to an embodiment of the disclosure, in a case in which the position sensor 18*b* is not provided, the speed calculator 23*a* may calculate a RPM value w of the first drum motor 41 based on driving current values $I_{abc}$ measured by the current sensor 18*a*.

The input coordinate converter 23*b* may convert three-phase driving current values $I_{abc}$ into a d-axis current value $I_d$ and a q-axis current value $I_q$ based on the rotor electrical angle θ. In other words, the input coordinate converter 23*b* may perform axis-conversion of an a-axis, a b-axis, and a c-axis of the three-phase driving current values $I_{abc}$ into a d-axis and a q-axis. Herein, the d-axis may be an axis extending in a direction that is identical to a direction of a magnetic field generated by the rotor of the first drum motor 41, and the q-axis may be an axis extending in a direction that is earlier by 90 degrees than the direction of the magnetic field generated by the rotor of the first drum motor 41. Herein, the 90 degrees may be an electrical angle not a mechanical angle of the rotor, and the electrical angle may be an angle obtained by changing an angle between neighboring N poles of the rotor or an angle between neighboring S poles of the rotor with respect to 360 degrees.

Also, the d-axis current value $I_d$ may represent a current component that generates a magnetic field in a d-axis direction among driving current, and the q-axis current value $I_q$ may represent a current component that generates a magnetic field in a q-axis direction among driving current.

The input coordinate converter 23*b* may calculate the q-axis current value $I_q$ and the d-axis current value $I_d$ from the three-phase driving current values $I_{abc}$ by using a known method.

Accordingly, the driving controller 405 may detect the q-axis current value $I_q$ and the d-axis current value $I_d$ that are currently applied to the motor.

The speed controller 23*c* may compare the RPM command ω* to the RPM value w of the first drum motor 41, and output a q-axis current reference value $I_q$* and a d-axis current reference value $I_d$* based on a result of the comparison. For example, the speed controller 23*c* may calculate a q-axis current reference value $I_q$* and a d-axis current reference value $I_d$* for controlling the first drum motor 41 based on a difference between a RPM command ω* and a RPM value w by using Proportional Integral (PI) control.

According to various embodiments of the disclosure, upon a reduction in RPM of the first drum motor 41, the speed controller 23*c* may calculate a q-axis current reference value $I_q$* and a d-axis current reference value $I_d$* regardless of a RPM command ω*.

The current controller 23*d* may compare the q-axis current reference value $I_q$* and the d-axis current reference value $I_d$* output from the speed controller 23*c* to the q-axis current value $I_q$ and the d-axis current value $I_d$ output from the input coordinate converter 23*b*, and output a q-axis voltage reference value $V_q$* and a d-axis voltage reference value $V_d$* based on a result of the comparison. More specifically, the current controller 23*d* may identify the q-axis voltage reference value $V_q$* based on a difference between the q-axis current reference value ω* and the q-axis current value $I_q$ by using PI control, and identify the d-axis voltage reference value $V_d$* based on a difference between the d-axis current reference value $I_d$* and the d-axis current value $I_d$.

The output coordinate converter 23*e* may convert the d-axis and q-axis voltage reference values $V_d$* and $V_q$* into three-phase voltage commands (an a-phase voltage command, a b-phase voltage command, and a c-phase voltage command) $V_{abc}$* based on the rotor electrical angle θ of the first drum motor 41.

The output coordinate converter 23*e* may convert the d-axis and q-axis voltage reference values $V_d$* and $V_q$* into the three-phase voltage commands $V_{abc}$* by using a known method.

The pulse width modulator 23*f* may generate a PWM control signal $V_{pwm}$ for turning on/off the switching devices Q1, Q2, Q3, Q4, Q5, and Q6 of the inverter circuit 430 from the three-phase voltage commands $V_{abc}$*. More specifically, the pulse width modulator 23*f* may perform pulse width modulation (PWM) on the three-phase voltage commands $V_{abc}$* and output a PWM signal $V_{pwm}$ obtained by the pulse width modulation to the gate driver 406.

As such, the driving controller 405 may output a driving signal (PWM signal) to the gate driver 406 based on the d-axis and q-axis current values $I_d$ and $I_q$ and the d-axis and q-axis current reference values $I_d$* and $I_q$.

As described above, the first driver 40 may supply driving current to the first drum motor 41 according to a motor control signal from the controller 23.

The first drum motor 41 may rotate or slow down the first drum 30 depending on the driving current applied from the first driver 40.

The controller 23 may generate a motor control signal corresponding to an algorithm of an operation washing course.

Figure 9:
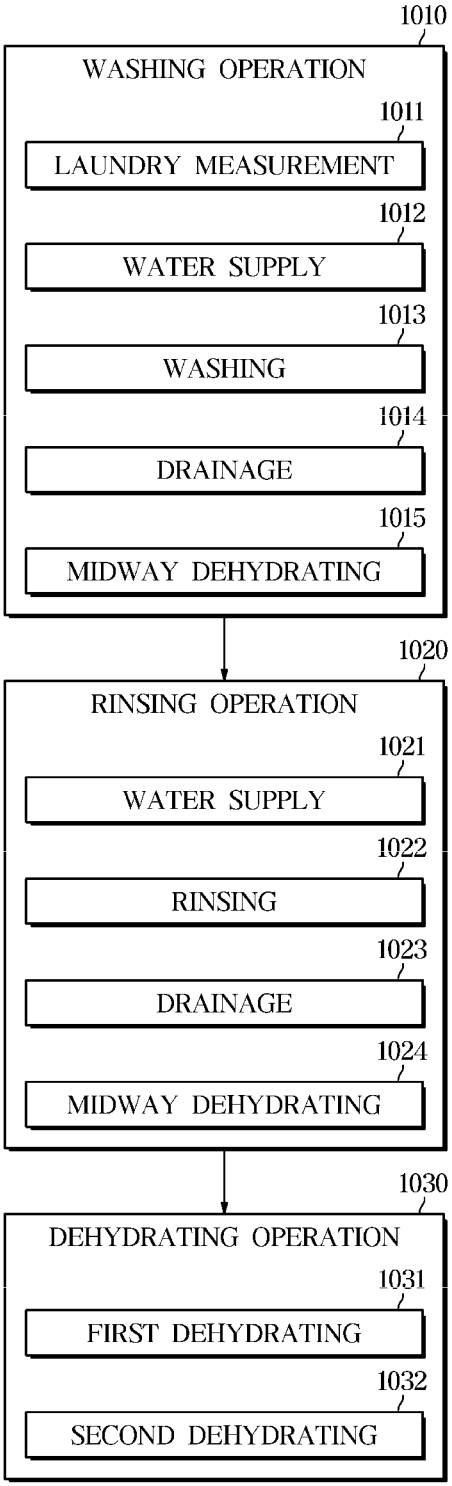
FIG. 9 shows an example of an operation cycle of a first clothes treating apparatus according to an embodiment of the disclosure.

FIG. 9 shows an example of an operation cycle of a first clothes treating apparatus according to an embodiment of the disclosure.

Referring to FIG. 9, the first clothes treating apparatus 10 may perform a washing operation 1010, a rinsing operation 1020, and a dehydrating operation 1030 sequentially according to a user input.

According to an embodiment of the disclosure, the first clothes treating apparatus 10 may perform the washing operation 1010, the rinsing operation 1020, and the dehydrating operation 1030 sequentially based on an operation course algorithm selected by the user interface device 15.

By the washing operation 1010, laundry may be washed. More specifically, foreign materials adhered to the laundry may be separated from the laundry by chemical actions of a detergent and/or physical actions such as falling.

The washing operation 1010 may include laundry measurement 1011 of measuring an amount of laundry, water supply 1012 of supplying water to the tub 20, washing 1013 of washing laundry by rotating the first drum 30 at low speed, drainage 1014 of discharging water stored in the tub 20, and midway dehydrating 1015 of separating water from laundry by rotating the first drum 30 at high speed.

For the washing 1013, the controller 23 may control the first driver 40 to rotate the first drum motor 41 forward (for example, a clockwise direction) or backward (for example, a counterclockwise direction). While the first drum 30 rotates, laundry may fall from an upper portion of the first drum 30 to a lower portion of the first drum 30 to be washed.

For the midway dehydrating 1015, the controller 23 may control the first driver 40 to rotate the first drum motor 41 at high speed. While the first drum 30 rotates at high speed, water may be separated from the laundry accommodated in the first drum 30 and discharged to outside of the first clothes treating apparatus 10.

During the midway dehydrating 1015, RPM of the first drum 30 may increase in stages. For example, the controller 23 may control the first driver 40 to rotate the first drum motor 41 at first RPM, and while the first drum motor 41 rotates at the first RPM, the controller 23 may control the first drum motor 41 to increase the first RPM to second RPM, based on a change of driving current of the first drum motor 41. While the first drum motor 41 rotates at the second RPM, the controller 23 may control the first drum motor 41 to increase the second RPM to third RPM or to decrease the second RPM to the first RPM, based on a change of driving current of the first drum motor 41.

By the rinsing operation 1020, the laundry may be rinsed. More specifically, a detergent or foreign materials remaining in the laundry may be washed away by water.

The rinsing operation 1020 may include water supply 1021 of supplying water to the tub 20, rinsing 1022 of rinsing the laundry by driving the first drum 30, drainage 1023 of discharging water stored in the tub 20, and midway dehydrating 1024 of separating water from the laundry by driving the first drum 30.

The water supply 1021, the drainage 1023, and the midway dehydrating 1024 of the rinsing operation 1020 may be the same as the water supply 1012, the drainage 1014, and the midway dehydrating 1015 of the washing operation 1010, respectively. During the rinsing operation 1020, the water supply 1021, the rinsing 1022, the drainage 1023, and the midway dehydrating 1024 may be performed once or several times.

By the dehydrating operation 1030, the laundry may be dehydrated. More specifically, water may be separated from the laundry by a high-speed rotation of the first drum 30, and the separated water may be discharged to the outside of the first clothes treating apparatus 10.

The dehydrating operation 1030 may include first dehydrating 1031 and second dehydrating 1032 of separating water from the laundry by rotating the first drum 30 at high speed. Due to the first dehydrating 1031 and the second dehydrating 1032, final midway dehydrating 1024 of the rinsing operation 1020 may be omitted.

The first dehydrating 1031 and the second dehydrating 1032 will be described below with reference to FIG. 10.

For the dehydrating operation 1030, the controller 23 may control the first driver 40 to rotate the first drum motor 41 at high speed. While the first drum 30 rotates at high speed, water may be separated from the laundry accommodated in the first drum 30 and discharged to the outside of the first clothes treating apparatus 10. Also, RPM of the first drum motor 41 may increase in stages.

Because an operation of the first clothes treating apparatus 10 terminates by the dehydrating operation 1030, an execution time of the dehydrating operation 1030 may be longer than execution times of the midway dehydrating 1015 and 1024.

As described above, the first clothes treating apparatus 10 may perform the washing operation 1010, the rinsing operation 1020, and the dehydrating operation 1030 to wash laundry. Particularly, during the midway dehydrating 1015 and 1024 and the dehydrating operation 1030, the first clothes treating apparatus 10 may increase RPM of the first drum motor 41 for rotating the first drum 30 in stages, and increase or decrease RPM of the first drum motor 41 based on a change of driving current of the first drum motor 41.

A dehydrating operation described in the entire specification may represent all of the midway dehydrating 1015 that is performed in the washing operation 1010, the midway dehydrating 1024 that is performed in the rinsing operation 1020, and the dehydrating operation 1030. Hereinafter, for convenience of description, a dehydrating operation is assumed to be the dehydrating operation 1030 that is performed after the rinsing operation 1020.

Figure 10:
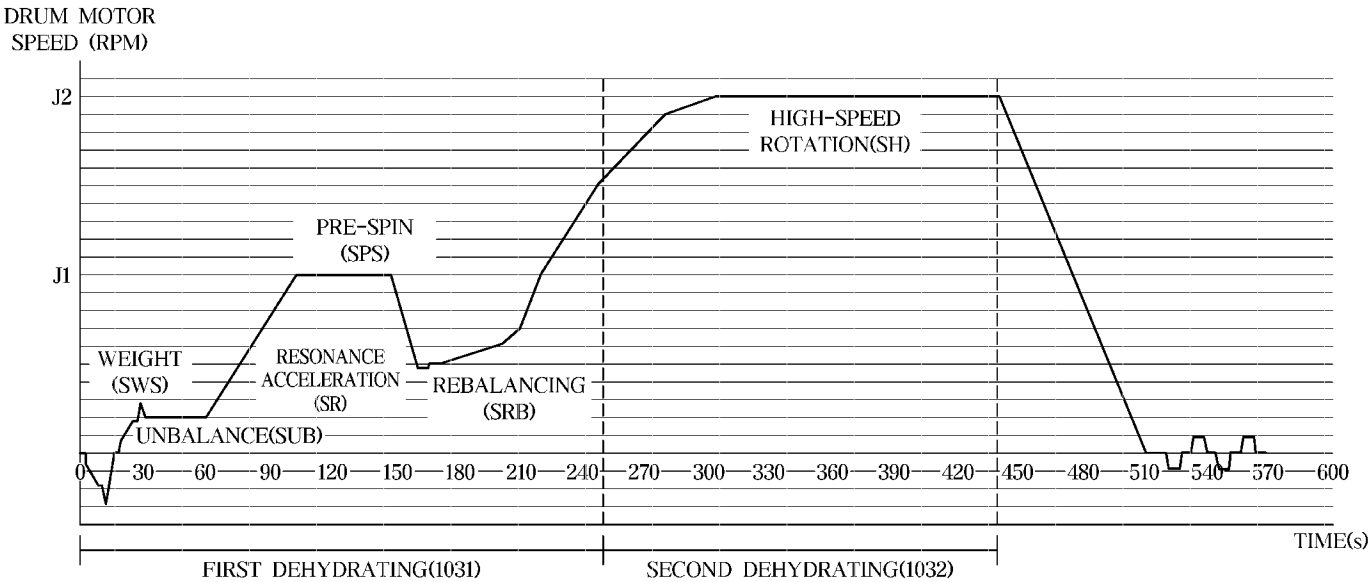
FIG. 10 shows an example of an operation revolutions per minute (RPM) profile of a drum motor in an operation of an operation cycle of a first clothes treating apparatus according to an embodiment of the disclosure.

FIG. 10 shows an example of an operation RPM profile of a drum motor in an operation of an operation cycle of a first clothes treating apparatus according to an embodiment of the disclosure.

Referring to FIG. 10, a dehydrating operation 1030 may include a weight detection section SWS for detecting a weight of laundry, an unbalance detection section SUB for detecting eccentricity of the laundry, a resonance acceleration section SR in which vibrations are generated by a rotation of the first drum 30, a pre-spin section SPS for a preliminary dehydration rotation, a rebalancing section SRB for equally distributing the laundry inside the first drum 30, and a high-speed rotation section SH for a main dehydration rotation.

The first dehydrating 1031 may include the resonance acceleration section SR and the pre-spin section SP.

In the first dehydrating 1031, target maximum RPM of the first drum motor 41 may be a first value J1. The first value J1 may be set to different values depending on operation course algorithms. According to various embodiments of the disclosure, the first value J1 may be set between about 300 RPM and about 600 RPM.

A first value J1 in the low noise course may be smaller than a first value J1 in the time saving course.

The second dehydrating 1032 may include the high-speed rotation section SH.

In the second dehydrating 1032, target maximum RPM of the first drum motor 41 may be a second value J2.

The second value J2 may be greater than the first value J1. According to various embodiments of the disclosure, the second value J2 may be set between about 800 RPM and about 1300 RPM.

The second value J2 may be set to different values depending on operation course algorithms.

For example, a second value J2 in the low noise course may be smaller than a second value J2 in the time saving course.

A dehydration profile shown in FIG. 10 may be corrected, or changed or adjusted, according to an operation course algorithm.

According to various embodiments of the disclosure, a first value J1 and a second value J2 shown in FIG. 10 may be changeable according to an operation course algorithm.

Figure 11:
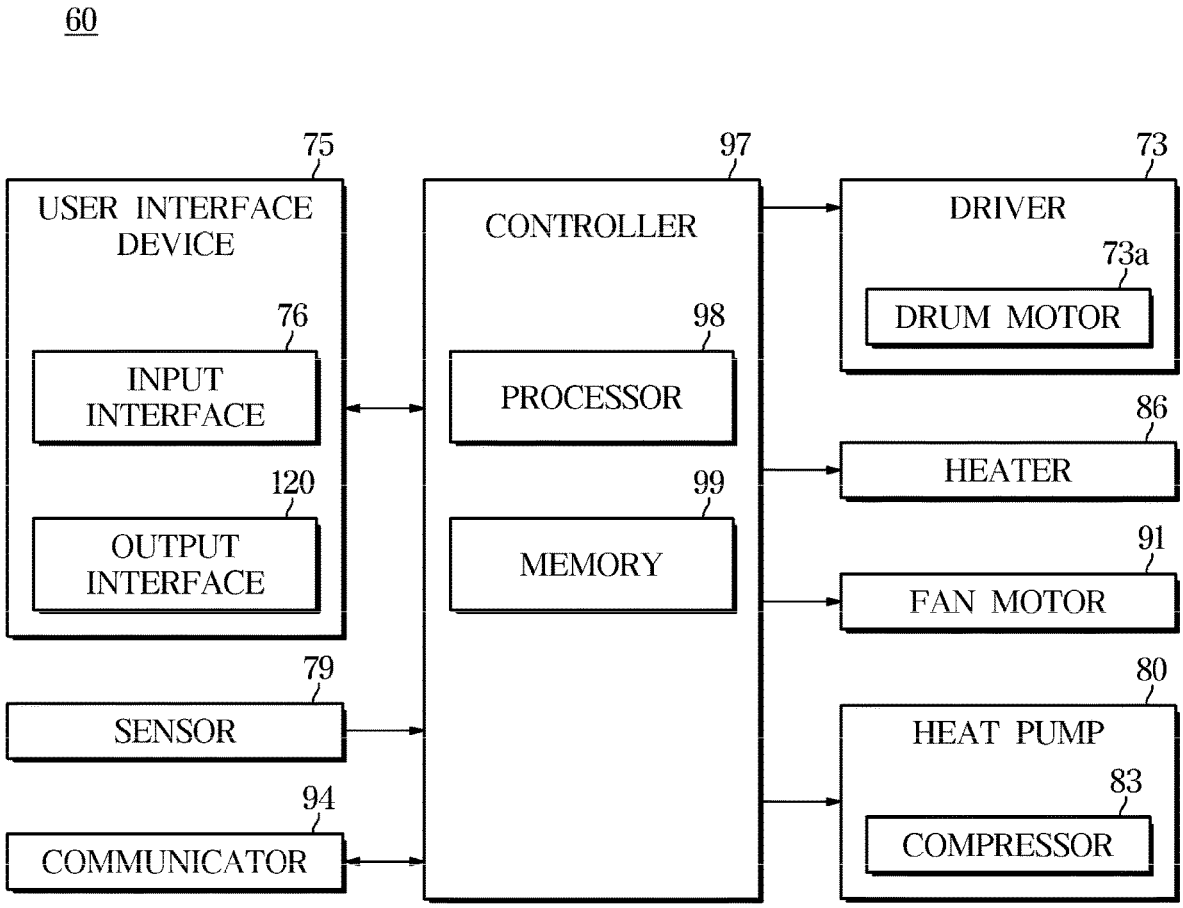
FIG. 11 is a control block diagram of a second clothes treating apparatus according to an embodiment of the disclosure.

FIG. 11 is a control block diagram of a second clothes treating apparatus according to an embodiment of the disclosure.

Referring to FIG. 11, according to an embodiment of the disclosure, the second clothes treating apparatus 60 may include a user interface device 75, a second driver 73, a heater 86, a fan motor 91, a heat pump 80, a communicator 94, a sensor 79, and a controller 97.

The user interface device 75 may provide a user interface to enable a user to interact with the second clothes treating apparatus 60.

The user interface device 75 may include at least one input interface 76 and at least one output interface 77.

According to an embodiment of the disclosure, the user interface device 75 may be positioned at one side of the second housing 61, although a location of the user interface device 75 is not limited thereto.

The least one input interface 76 may convert sensory information received from a user into an electrical signal.

The at least one input interface 76 may include a power button, an operation button, a course selection dial (or a course selection button), and a drying setting button. The at least one input button 76 may include, for example, a tact switch, a push switch, a slide switch, a toggle switch, a micro switch, a touch switch, a touch pad, a touch screen, a jog dial, and/or a microphone, etc.

The at least one output interface 77 may generate sensory information and transfer various data related to an operation of the second clothes treating apparatus 60 to a user.

For example, the at least one output interface 77 may transfer information related to drying courses and operation times of the second clothes treating apparatus 60 or drying settings to a user. Information related to operations of the second clothes treating apparatus 10 may be output through a screen, an indicator, a voice, etc. The at least one output interface 77 may include, for example, a LCD panel, a LED panel, a speaker, etc.

The drying courses may include drying settings (for example, drying temperature, a drying time, strength of drying, etc.) set in advance by a designer of the second clothes treating apparatus 60 according to kinds (for example, bedclothes, underwear, etc.) and materials (for example, wool, etc.) of an object to be dried. For example, standard drying may include drying settings capable of being applied to most of objects to be dried, and bedclothes drying may include drying settings optimized to dry bedclothes. The drying courses may be divided into, for example, standard drying, strong drying, delicate clothes drying, bedclothes drying, baby clothes drying, towel drying, small drying, power saving drying, outdoor clothes drying, etc.

According to various embodiments of the disclosure, the drying courses may include a plurality of courses according to users' needs. For example, the drying courses may include an energy saving course, a time saving course, a low noise course, etc.

The energy saving course may be a course for reducing energy that is consumed to perform a drying course. While the second clothes treating apparatus 60 performs a drying cycle corresponding to the energy saving course, an operation of the heater 86 may be reduced.

The time saving course may correspond to a course for reducing a time that is consumed to perform a drying course. While the second clothes treating apparatus 60 performs a drying cycle corresponding to the time saving course, an operation time of the heater 86 and/or an operating frequency of the compressor 83 may increase.

The low noise course may be a course for reducing noise that is generated from the second clothes treating apparatus 60 while a drying operation is performed. While the second clothes treating apparatus 60 performs a drying operation corresponding to the low noise course, maximum RPM of the second drum 70 may be reduced.

In the disclosure, courses, such as the energy saving course, the time saving course, and the low noise course, according to users' special needs may be defined as specialized courses.

In the disclosure, remaining courses (for example, a standard course) except for the specialized courses may be defined as normal courses.

A memory 99 may store a plurality of drying course algorithms corresponding to a plurality of drying courses. The plurality of drying course algorithms may be algorithms for controlling a plurality of components (for example, the second driver 73, the heater 86, the fan motor 91, and/or the compressor 83) in a drying operation.

A processor 98 may perform a drying operation based on an algorithm of an operation course selected based on a user input from among the plurality of drying course algorithms stored in the memory 99.

The second driver 73 may include the second drum motor 73*a* that provides a driving force for rotating the second drum 70. The second driver 73 may operate based on a control signal from the controller 97.

According to various embodiments of the disclosure, the controller 97 may control the second driver 73 based on an algorithm of an operation course selected by a user.

An aspect of the second driver 73 may be the same as that of the first driver 40 described above with reference to FIG. 7.

The heater 86 may further heat air heated by passing through the condenser 82, or the heater 86 may heat air received from the outside without being heated through the heat pump 80.

The heater 86 may operate based on a control signal from the controller 97.

According to various embodiments of the disclosure, the controller 97 may control the heater 86 based on an algorithm of an operation course selected by a user.

The fan motor 91 may rotate the fan 90 for circulating inside air of the second housing 61.

The fan motor 91 may operate based on a control signal from the controller 97.

According to various embodiments of the disclosure, the controller 97 may control the fan motor 91 based on an algorithm of an operation course selected by a user.

As described above, the fan motor 91 for rotating the fan 90 and the second drum motor 73*a* for rotating the second drum 70 may be the same component.

According to an embodiment of the disclosure, in a case in which a single motor 91 and 73*a* is connected to different rotating shafts to rotate the fan 90 and the second drum 70 simultaneously, the controller 97 may drive the single motor 91 and 73*a* at target RPM corresponding to target RPM of the fan 90 or target RPM of the second drum 70.

According to various embodiments of the disclosure, the fan motor 91 for rotating the fan 90 and the second drum motor 73*a* for rotating the second drum 70 may be separate components. In this case, the controller 97 may drive the fan motor 91 based on target RPM of the fan 90 and drive the second drum motor 73*a* based on target RPM of the second drum 70.

The heat pump 80 may be a component for generating hot air that is to be supplied to the second drum 70, and may include the compressor 83 for compressing a refrigerant.

The compressor 83 may operate based on a control signal from the controller 97.

According to various embodiments of the disclosure, the controller 97 may control the compressor 83 based on an algorithm of an operation course selected by a user.

The sensor 79 may include at least one sensor for obtaining information related to an operation state of the second clothes treating apparatus 60.

According to various embodiments of the disclosure, the sensor 79 may include at least one sensor for detecting a weight of an object to be dried, accommodated in the second drum 70.

According to various embodiments of the disclosure, the sensor 79 may include a temperature sensor for detecting inside temperature of the second housing 61 and/or a sensor for detecting an operation state of the second driver 73.

The temperature sensor for detecting inside temperature of the second housing 61 may be provided at any location inside the second housing 61. According to various embodiments of the disclosure, the temperature sensor may be provided at an exit of the condenser 82 or at downstream of the heater 86.

According to various embodiments of the disclosure, the sensor 79 may include a vibration sensor for detecting a vibration value of the second housing 61.

The second clothes treating apparatus 60 may include the communicator 94 for communicating with an external device (for example, a server, a user device, and/or another home appliance) in a wired and/or wireless manner.

The user device and/or the other home appliance may include various electronic devices, such as a smart phone, a notebook, a laptop, a smart watch, an IoT hub device, another home appliance (for example, a television and/or the second clothes treating apparatus 60), a stationary type tablet, and a speaker.

The communicator 94 may include a short-range communication module and/or a long-distance communication module.

The communicator 94 may transmit data to an external device or receive data from the external device. For example, the communicator 94 may establish communication with a server, a user device, and/or another home appliance, and transmit/receive various data to/from the server, the user device, and/or the other home appliance.

For this, the communicator 94 may support establishment of a direct (for example, wired) communication channel or a wireless communication channel with an external device, and communications through an established communication channel. According to an embodiment of the disclosure, the communicator 94 may include a wireless communication module (for example, a cellular communication module, a short-range wireless communication module, or a GNSS communication module) or a wired communication module (for example, a LAN communication module or a power line communication module). A corresponding communication module among the communication modules may communicate with an external electronic device through a first network (for example, a short-range wireless communication network, such as Bluetooth, WiFi Direct, or IrDA) or a second network (for example, a long-distance wireless communication network, such as a legacy cellular network, a 5G network, a next-generation communication network, the Internet, or a computer network (for example, a LAN or WAN)). The various kinds of communication modules may be integrated into a single component (for example, a single chip) or implemented with a plurality of separate components (for example, a plurality of chips).

The short-range wireless communication module may include a Bluetooth communication module, a BLE communication module, a NFC module, a WLAN (WiFi) communication module, a Zigbee communication module, an IrDA communication module, a WFD communication module, a UWB communication module, an Ant+ communication module, a uWave communication module, etc., although not limited thereto.

The long-distance wireless communication module may include a communication module that performs various kinds of long-distance communications, and may include a mobile communicator. The mobile communicator may transmit/receive a wireless signal to/from at least one of a base station, an external terminal, or a server on a mobile communication network.

According to an embodiment of the disclosure, the communicator 94 may communicate with an external device, such as a server, a user device, another home appliance, etc., through a surrounding AP. The AP may connect a LAN to which the second clothes treating apparatus 60 and/or a user device and/or another home appliance is connected to a WAN to which a server is connected. The second clothes treating apparatus 60 and/or the user device and/or the other home appliance may be connected to the server through the WAN.

The controller 97 may control various components (for example, the second driver 73, the heater 86, the fan motor 91, and/or the compressor 83) of the second clothes treating apparatus 60. The controller 97 may control various components of the second clothes treating apparatus 60 to perform a drying operation according to a user input. For example, the controller 97 may control the second drum motor 73*a* of the second driver 73 to regulate RPM of the second drum 70, control an operation of the heater 86 to rapidly heat inside air of the second drum 70, regulate an operation of the compressor 83 to generate hot air that is to be supplied to the second drum 70, or control an operation of the fan motor 91 to circulate hot air generated by the heat pump 80 to the inside of the second drum 70.

The controller 97 may include hardware, such as a CPU, a Micom, ora memory, and software such as a control program. For example, the controller 97 may include at least one memory 99 that stores data in a form of an algorithm or program for controlling operations of components in the second clothes treating apparatus 60, and at least one processor 98 that performs the above-described operations and operations which will be described below by using data stored in the at least one memory 99. The memory 99 and the processor 98 may be implemented as separate chips. The processor 98 may include one, two, or more processor chips or one, two, or more processing cores. The memory 99 may include one, two, or more memory chips or one, two, or more memory blocks. Also, the memory 99 and the processor 98 may be implemented as a single chip.

Figure 12:
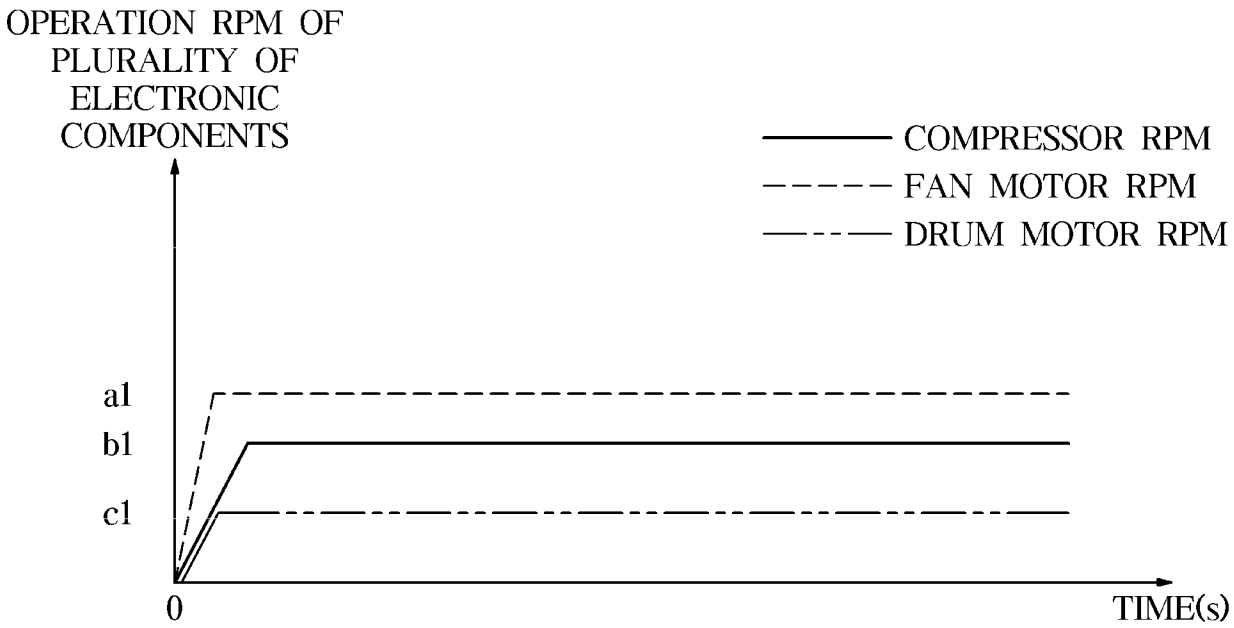
FIG. 12 shows examples of operation RPM profiles of a plurality of electronic components in an operation of a second clothes treating apparatus according to an embodiment of the disclosure.

FIG. 12 shows examples of operation RPM profiles of a plurality of electronic components in an operation of a second clothes treating apparatus according to an embodiment of the disclosure.

Referring to FIG. 12, the second clothes treating apparatus 60 may control the compressor 83, the fan motor 91, and/or the second drum motor 73*a*, based on an operation course algorithm.

According to an embodiment of the disclosure, the second clothes treating apparatus 60 may start a drying operation in response to reception of a start command for a course selected through a user interface device 100.

The second clothes treating apparatus 60 may control a plurality of electronic components (for example, the compressor 83, the heater 86, the fan motor 91, and/or the second drum motor 73*a*) based on an operation course algorithm.

The drying operation may include operating the compressor 83, the heater 86, the fan motor 91, and/or the second drum motor 73*a* according to an operation course algorithm.

According to various embodiments of the disclosure, in a case in which the fan motor 91 and the second drum motor 73*a* are implemented as a single second motor 91 and 73*a*, the drying operation may include operating the single second motor 91 and 73*a* according to an operation course algorithm.

According to various embodiments of the disclosure, in a case in which the fan motor 91 and the second drum motor 73*a* are implemented as different motors 91 and 73*a*, the drying operation may include operating the fan motor 91 and the second drum motor 73*a* according to an operation course algorithm.

The controller 97 may set target RPM of the fan motor 91 to a preset value a1, set target RPM of the compressor 83 to a preset value b1, and set target RPM of the second drum motor 73*a* to a preset value c1, according to an operation course algorithm, in response to a start of a drying operation.

In the case in which the fan motor 91 and the second drum motor 73*a* are implemented as a single motor, the controller 97 may set target RPM of the fan motor 91 or the second drum motor 73*a* to a preset value, according to an operation course algorithm, in response to a start of a drying operation.

The controller 97 may rapidly heat inside air of the second housing 61 by operating the heater 86 for a preset time in an initial stage of the drying operation.

According to an embodiment of the disclosure, the controller 97 may simply set target RPM of the compressor 83, or the controller 97 may set target temperature and then dynamically control target RPM of the compressor 83 such that temperature detected through the sensor 79 follows the target temperature, according to various operation course algorithms.

According to an embodiment of the disclosure, the controller 97 may simply set target RPM of the fan motor 91 and/or the second drum motor 73*a*, or the controller 97 may set target temperature and then dynamically control target RPM of the fan motor 91 and/or the second drum motor 73*a* based on a weight of an object to be dried, detected through the sensor 79, according to various operation course algorithms.

As such, the first clothes treating apparatus 10 may perform various operations (for example, the washing operation 1010, the rinsing operation 1020, and the dehydrating operation 1030), whereas the second clothes treating apparatus 60 may relatively simply perform only the drying operation.

Figure 13:
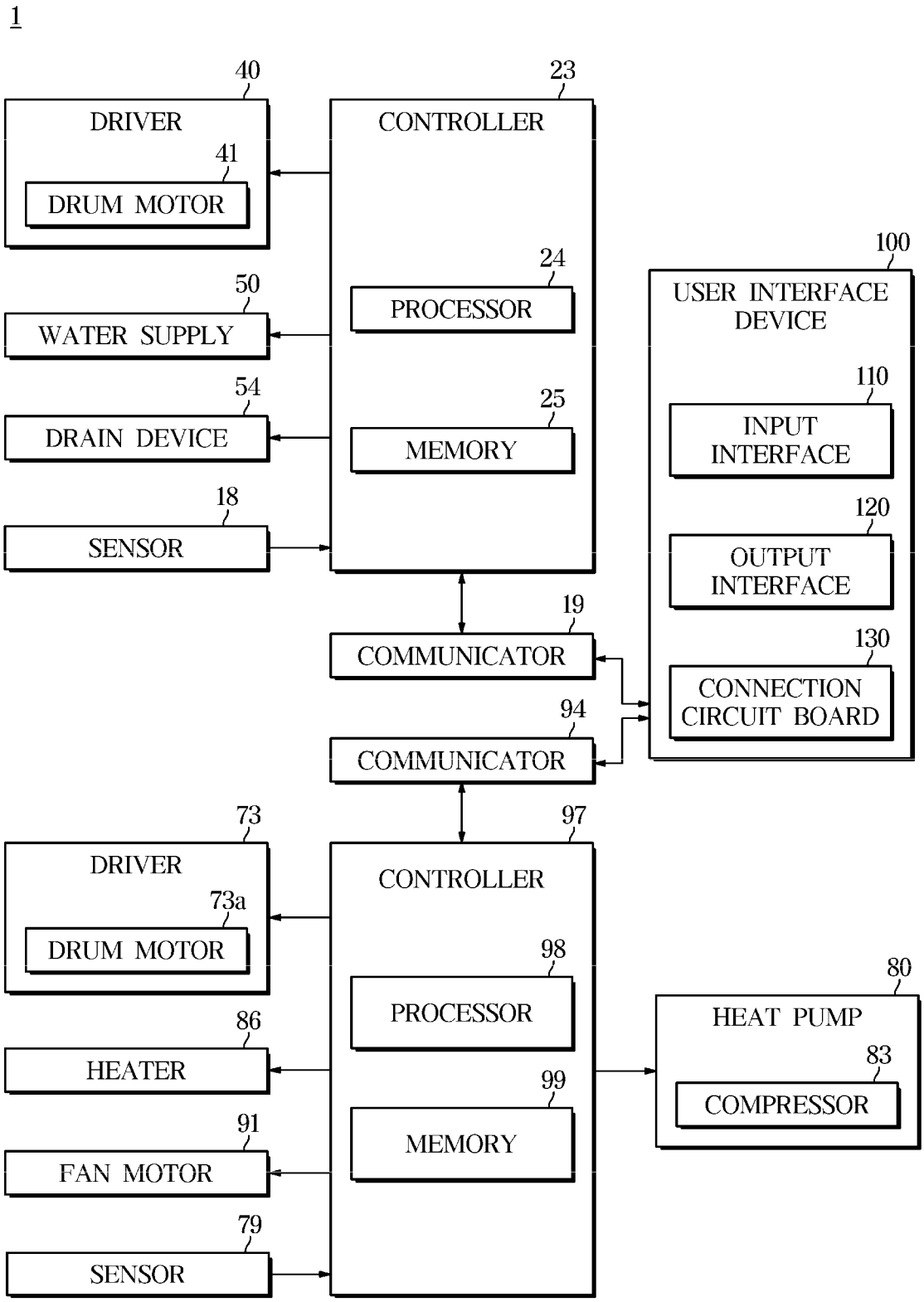
FIG. 13 is a control block diagram of a clothes treating system according to an embodiment of the disclosure.

FIG. 13 is a control block diagram of a clothes treating system according to an embodiment of the disclosure.

Referring to FIG. 13, a clothes treating system 1 according to an embodiment of the disclosure may include the first clothes treating apparatus 10 and the second clothes treating apparatus 60.

The first clothes treating apparatus 10 may be connected operatively and/or electrically to the second clothes treating apparatus 60.

Various information obtained in the first clothes treating apparatus 10 may be transferred to the second clothes treating apparatus 60, and various information obtained in the second clothes treating apparatus 60 may be transferred to the first clothes treating apparatus 10.

According to an embodiment of the disclosure, the clothes treating system 1 may include the user interface device 100.

The user interface device 100 may be provided in the first clothes treating apparatus 10 and/or the second clothes treating apparatus 60.

According to an embodiment of the disclosure, the user interface device 100 may be positioned at one side of the first housing 11.

The user interface device 100 of the clothes treating system 1 may be a component for controlling both the first clothes treating apparatus 10 and the second clothes treating apparatus 60, and may be defined as an integrated user interface device 100.

According to an embodiment of the disclosure, in the clothes treating system 1 including the user interface device 100, the first clothes treating apparatus 10 may not include the user interface device 15 for controlling only the first clothes treating apparatus 10.

According to an embodiment of the disclosure, in the clothes treating system 1 including the user interface device 100, the second clothes treating apparatus 60 may not include the user interface device 75 for controlling only the second clothes treating apparatus 60.

According to various embodiments of the disclosure, although the clothes treating system 1 includes the user interface device 100, the first clothes treating apparatus 10 may include the user interface device 15 for controlling only the first clothes treating apparatus 10. As another example, although the clothes treating system 1 includes the user interface device 100, the second clothes treating apparatus 60 may include the user interface device 75 for controlling only the second clothes treating apparatus 60. As another example, although the clothes treating system 1 includes the user interface device 100, the first clothes treating apparatus 10 may include the user interface device 15 for controlling only the first clothes treating apparatus 10, and the second clothes treating apparatus 60 may include the user interface device 75 for controlling only the second clothes treating apparatus 60.

That is, according to an embodiment of the disclosure, the clothes treating system 1 may include the user interface device 100 for controlling the first clothes treating apparatus 10 and the second clothes treating apparatus 60, the user interface device 15 for controlling the first clothes treating apparatus 10, and/or the user interface device 75 for controlling the second clothes treating apparatus 60.

The user interface device 100 may provide a user interface for enabling a user to interact with the clothes treating system 1. The user interface for enabling a user to interact with the clothes treating system 1 may be a user interface for enabling a user to interact with the first clothes treating apparatus 10 and the second clothes treating apparatus 60.

The user interface device 100 may include at least one input interface 110 and at least one output interface 120.

The at least one input interface 110 may convert sensory information received from a user into an electrical signal and transfer the electrical signal to the first clothes treating apparatus 10 and/or the second clothes treating apparatus 60.

The at least input interface 110 may include a tact switch, a push switch, a slide switch, a toggle switch, a micro switch, a touch switch, a touch pad, a touch screen, a jog dial, and/or a microphone, etc.

According to an embodiment of the disclosure, the at least one input interface 110 may transfer a control command corresponding to a user input to the controller 23 (hereinafter, also referred to as a 'first controller 23') of the first clothes treating apparatus 10 and the controller 97 (hereinafter, also referred to as a 'second controller 97') of the second clothes treating apparatus 60.

The at least one output interface 120 may transfer various data related to operations of the first clothes treating apparatus 10 and the second clothes treating apparatus 60 to a user by generating sensory information.

The at least one output interface 120 may include a LCD panel, a LED panel, a speaker, etc.

A panel on which the at least one input interface 110 and the at least one output interface 120 are formed may be defined as a control panel.

The at least one input interface 110 and the at least one output interface 120 will be described in more detail with reference to FIGS. 14A and 14B, below.

The first clothes treating apparatus 10 and the second clothes treating apparatus 60 may communicate with each other through the communicator 19 (hereinafter, referred to as a 'first communicator 19') of the first clothes treating apparatus 10 and the communicator 94 (hereinafter, referred to as a 'second communicator 94') of the second clothes treating apparatus 60.

According to an embodiment of the disclosure, the communicator 19 may directly communicate with the communicator 94 through a Device-to-Device (D2D) wireless communication module (for example, a Bluetooth module).

According to an embodiment of the disclosure, the communicator 19 may communicate with the communicator 94 via a server through a WAN.

According to various embodiments of the disclosure, each of the communicators 19 and 94 may include a wired communication module (for example, a communication connector and/or a communication wire), and the first clothes treating apparatus 10 may be connected to the second clothes treating apparatus 60 in a wired manner.

According to various embodiments of the disclosure, the user interface device 100 may further include a connection circuit board 130. The connection circuit board 130 may be implemented as a printed circuit board.

The connection circuit board 130 may include a communication wire and/or a communication connector that is connected to the first communicator 19 and the second communicator 94.

The connection circuit board 130 may connect the first communicator 19 to the second communicator 94 through a wire.

Each of the first communicator 19 and the second communicator 94 may be connected to the connection circuit board 130.

The connection circuit board 130 may mediate data exchange between the first controller 23 and the second controller 97.

For example, the connection circuit board 130 may transfer a signal transferred from the first controller 23 through the first communicator 19 to the second controller 97 through the second communicator 94.

As another example, the connection circuit board 130 may transfer a signal transferred from the second controller 97 through the second communicator 94 to the first controller 23 through the first communicator 19.

According to various embodiments of the disclosure, the connection circuit board 130 may transfer course information selected by the at least one input interface 110 to the first controller 23 through the first communicator 19.

According to various embodiments of the disclosure, the connection circuit board 130 may transfer course information selected by the at least one input interface 110 to the second controller 97 through the second communicator 94.

According to the disclosure, because the user interface device 100 includes the connection circuit board 130, communication between the first clothes treating apparatus 10 and the second clothes treating apparatus 60 may be stably performed, and also, communication of the user interface device 100 with the first clothes treating apparatus 10 and the second clothes treating apparatus 60 may be stably performed.

Figure 14A:
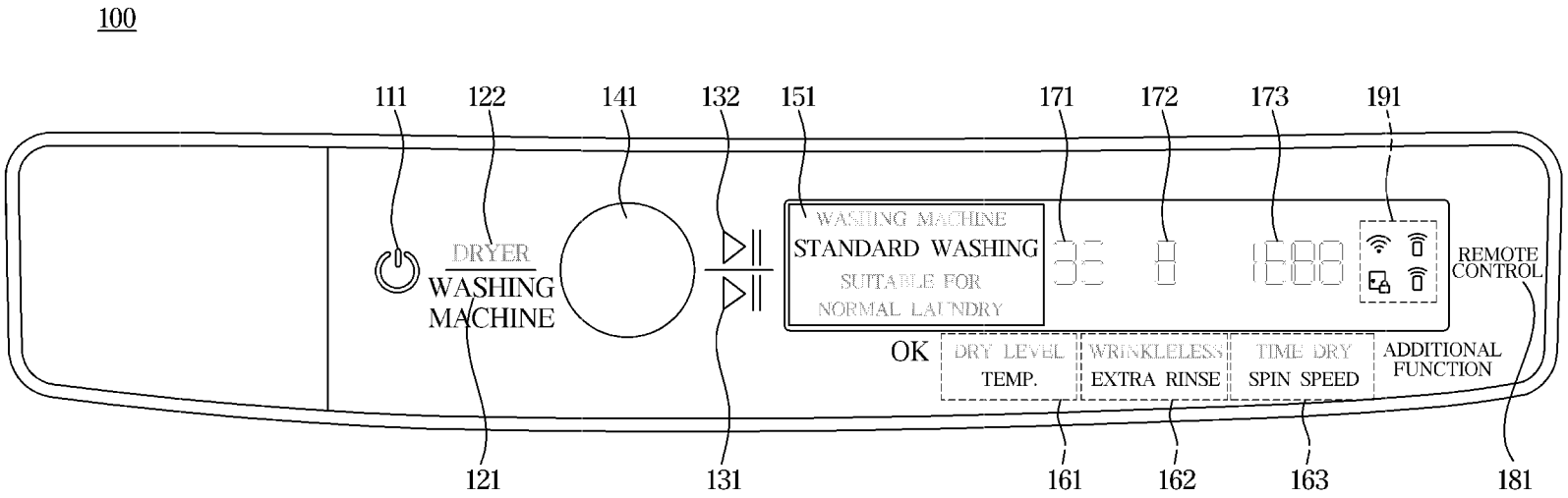
FIGS. 14A and 14B show an example of an appearance of a user interface device according to an embodiment of the disclosure.
Figure 14B:
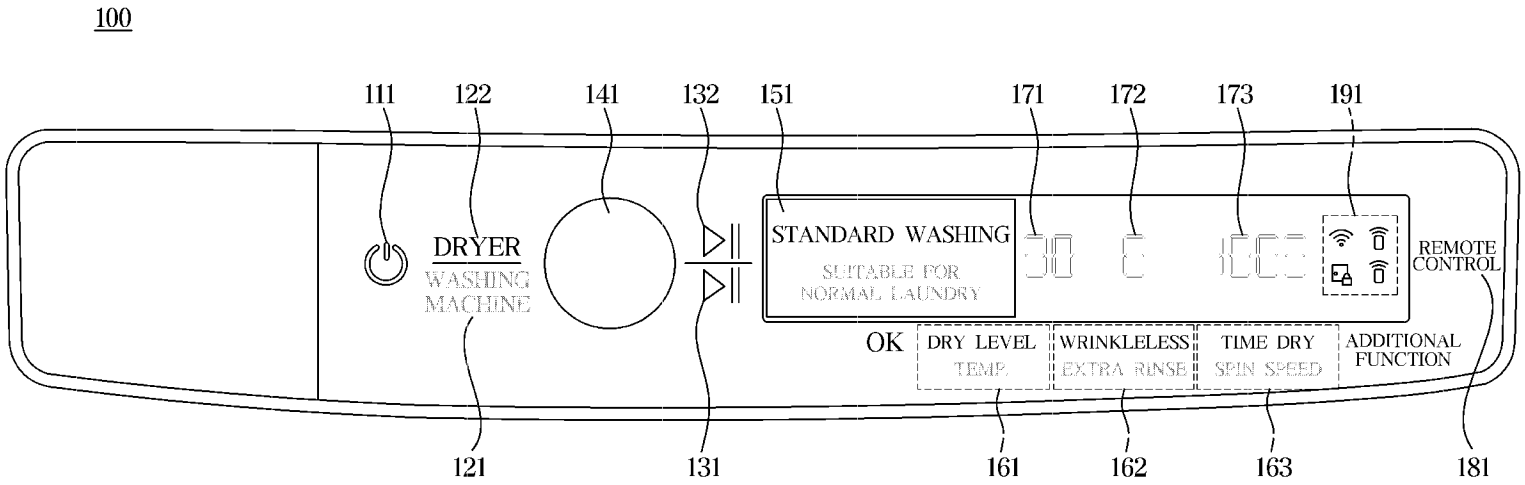

FIGS. 14A and 14B show an example of an appearance of the user interface device 100 according to an embodiment of the disclosure.

Referring to FIGS. 14A and 14B, the user interface device 100 may include a power button 111, device selection indicators 121 and 122, operation buttons 131 and 132, a device and course selection dial (ora device and course selection button) 141, a display 151, washing/rinsing/dehydrating/drying setting indicators 161, 162, 163, 171, 172, and 173, a communication button 181, and a communication indicator 191.

The device selection indicators 121 and 122 and/or the washing/rinsing/dehydrating/drying setting indicators 161, 162, 163, 171, 172, and 173 may function as both the output interface 120 and the input interface 110.

Power may be supplied to the user interface device 100 in response to a selection of the power button 111.

The device selection indicators 121 and 122 may represent a device selected by the device and course selection dial 141.

A user may select a device which he/she wants to use from among the first clothes treating apparatus 10 and the second clothes treating apparatus 60 through the device and course selection dial 141, and check the currently selected device through the device selection indicators 121 and 122.

In the clothes treating system 1 in which the second clothes treating apparatus 60 is stacked on the first clothes treating apparatus 10, the device selection indicator 121 corresponding to the first clothes treating apparatus 10 among the device selection indicators 121 and 122 may be positioned below the device selection indicator 122 corresponding to the second clothes treating apparatus 60. Meanwhile, in the clothes treating system 1 in which the first clothes treating apparatus 10 is stacked on the second clothes treating apparatus 60, the device selection indicator 121 corresponding to the first clothes treating apparatus 10 among the device selection indicators 121 and 122 may be positioned above the device selection indicator 122 corresponding to the second clothes treating apparatus 60. According to the disclosure, the user may intuitively select a clothes treating apparatus which he/she wants to use.

The user may finally select the currently selected device by pressing the device and course selection dial 141.

According to various embodiments of the disclosure, each of the device selection indicators 121 and 122 may be implemented as a tact switch, a push switch, a slide switch, a toggle switch, a micro switch, a touch switch, a touch pad, a touch screen, etc. In this case, the user may select a device by selecting one of the device selection indicators 121 and 122.

Each of the device selection indicators 121 and 122 may have a device selection function. In this case, the device and course selection dial 141 may be used to select a course.

A visual mark output through the at least one output interface 120 upon a selection of the first clothes treating apparatus 10 by the device selection indicators 121 and 122 or the device and course selection dial 141 may be different from a visual mark output through the at least one output interface 120 upon a selection of the second clothes treating apparatus 60 by the device selection indicators 121 and 122 or the device and course selection dial 141.

According to a selection of the first clothes treating apparatus 10, a user interface for setting an operation course of the first clothes treating apparatus 10 may be provided through the at least one output interface 120, and according to a selection of the second clothes treating apparatus 60, a user interface for setting an operation course of the second clothes treating apparatus 60 may be provided through the at least one output interface 120.

The display 151 may provide information about a course currently selected from among a plurality of courses.

To perform a clothes treating operation in the currently selected course, the user may perform the clothes treating operation by selecting one of the operation buttons 131 and 132.

According to an embodiment of the disclosure, the operation buttons 131 and 132 may include a button for starting an operation course of a clothes treating apparatus currently selected from among the first clothes treating apparatus 10 or the second clothes treating apparatus 60.

According to various embodiments of the disclosure, the operation buttons 131 and 132 may include a button 131 for starting an operation course of the first clothes treating apparatus 10 and/or a button 132 for starting an operation course of the second clothes treating apparatus 60.

The button 131 for starting an operation course of the first clothes treating apparatus 10 may be separated from the button 132 for starting an operation course of the second clothes treating apparatus 60. In this case, the user who has set an operation course of the first clothes treating apparatus 10 and then set an operation course of the second clothes treating apparatus 60 may start the operation course of the first clothes treating apparatus 10 and the operation course of the second clothes treating apparatus 60 at the same time.

According to a selection of the first clothes treating apparatus 10, the washing/rinsing/dehydrating/drying setting indicators 161, 162, 163, 171, 172, and 173 may be converted to washing/rinsing/dehydrating setting indicators.

After the user selects a course, the user may make detail washing/rinsing/dehydrating settings in the course through the washing/rinsing/dehydrating setting indicators.

For example, the user may select an indicator 161 for a washing setting and then regulate a washing setting value through the device and course selection dial 141. A currently selected washing setting value may be displayed in a corresponding indicator 171.

The washing setting value may include, for example, temperature of washing water.

As another example, the user may select an indicator 162 for a rinsing setting and then regulate a rinsing setting value through the device and course selection dial 141. A currently selected rinsing setting value may be displayed in a corresponding indicator 172.

The rinsing setting value may include, for example, a number of times of rinsing.

As another example, the user may select an indicator 163 for a dehydrating setting and then regulate a dehydrating setting value through the device and course selection dial 141. A currently selected dehydrating setting value may be displayed in a corresponding indicator 173.

The dehydrating setting value may include, for example, strength of dehydrating.

According to a selection of the second clothes treating apparatus 60, the washing/rinsing/dehydrating/drying setting indicators 161, 162, 163, 171, 172, and 173 may be converted to drying setting indicators.

The user may select a course and then make detail drying settings in the course through the drying setting indicators.

For example, the user may select the indicator 161 for a degree-of-dryness setting and then regulate a degree-of-dryness setting value through the device and course selection dial 141. A currently selected degree-of-dryness setting value may be displayed in the corresponding indicator 171.

The degree-of-dryness setting value may include, for example, inside target temperature of the second drum 70.

As another example, the user may select the indicator 162 for an anti-wrinkle setting and then regulate an anti-wrinkle value through the device and course selection dial 141. A currently selected anti-wrinkle value may be displayed in the corresponding indicator 172.

The anti-wrinkle value may include, for example, target RPM of the second drum 70.

As another example, the user may select the indicator 163 for a time setting and then regulate a dehydrating setting value through the device and course selection dial 141. A currently selected time setting value may be displayed in the corresponding indicator 173.

The time setting value may include, for example, an operation time of the heater 86.

The communication button 181 may be a button for activating a communication function of the clothes treating system 1.

For example, the communication button 181 may include a button for activating a wireless communication module (for example, a WiFi communication module, a Bluetooth communication module, etc.) of the first communicator 19 and/or the second communicator 94.

The communication indicator 191 may provide a visual indicator representing a current communication state of the first clothes treating apparatus 10 and/or the second clothes treating apparatus 60.

According to the disclosure, a user may easily control both the first clothes treating apparatus 10 and the second clothes treating apparatus 60 through the single user interface device 100.

According to various embodiments of the disclosure, a command for starting a clothes treating operation according to a selected operation course may be received from an external device through the communicators 19 and 94.

According to various embodiments of the disclosure, the user interface device 100 may include an integrated controller functioning as the first controller 23 for controlling a plurality of electronic components of the first clothes treating apparatus 10 and the second controller 97 for controlling a plurality of electronic components of the second clothes treating apparatus 60.

In the case in which the user interface device 100 includes the integrated controller, the first clothes treating apparatus 10 and the second clothes treating apparatus 60 may not include the corresponding controllers 23 and 97, respectively.

Figure 15:
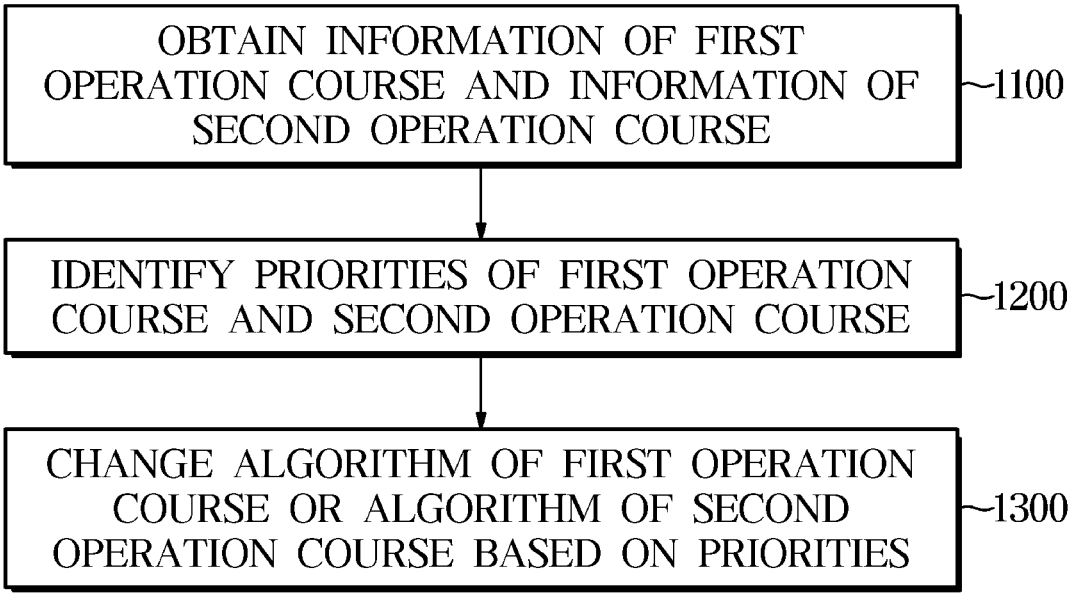
FIG. 15 is a flowchart showing an example of a method for controlling a clothes treating system according to an embodiment of the disclosure.

FIG. 15 is a flowchart showing an example of a method for controlling a clothes treating system according to an embodiment of the disclosure.

Referring to FIG. 15, the clothes treating system 1 may obtain information (hereinafter, referred to as 'information of a first operation course') about an operation course of the first clothes treating apparatus 10 and information (hereinafter, referred to as 'information of a second operation course') about an operation course of the second clothes treating apparatus 60 (operation 1100).

According to an embodiment of the disclosure, the user interface device 100 may transfer a start command for the first operation course of the first clothes treating apparatus 10 to the first controller 23, in response to reception of the start command for starting the first operation course.

The first controller 23 may control a plurality of electronic components (for example, the first drum motor 41, the water supply 50, and the drain device 54) based on an algorithm corresponding to the first operation course, in response to reception of the start command for starting the first operation course through the user interface device 100.

According to an embodiment of the disclosure, the user interface device 100 may transfer a start command for the second operation course of the second clothes treating apparatus 60 to the second controller 97, in response to reception of the start command for starting the second operation course.

The second controller 97 may control a plurality of electronic components (for example, the second drum motor 73*a* and/or the fan motor 91, the compressor 83, and the heater 86) based on an algorithm corresponding to the second operation course, in response to reception of the start command for starting the second operation course through the user interface device 100.

The first operation course may be a clothes treating course that is selected by a user and starts by the first clothes treating apparatus 10.

The second operation course may be a clothes treating course that is selected by a user and starts by the second clothes treating apparatus 60.

According to various embodiments of the disclosure, the user interface device 100 may transfer a start command for the second operation course of the second clothes treating apparatus 60 to the first controller 23, in response to reception of the start command for starting the second operation course. The first controller 23 may estimate an operation state of the second clothes treating apparatus 60 in response to reception of the start command for the second operation course.

According to various embodiments of the disclosure, the user interface device 100 may transfer a start command for the first operation course of the first clothes treating apparatus 10 to the second controller 97, in response to reception of the start command for starting the first operation course. The second controller 97 may estimate an operation state of the first clothes treating apparatus 10 in response to reception of the start command for the first operation course.

The clothes treating system 1 may identify priorities of the first operation course and the second operation course (operation 1200).

According to an embodiment of the disclosure, the first controller 23 may identify the priorities of the first operation course and the second operation course based on reception of the information about the first operation course and the information about the second operation course from the user interface device 100.

According to an embodiment of the disclosure, the second controller 97 may identify the priorities of the first operation course and the second operation course based on reception of the information about the first operation course and the information about the second operation course from the user interface device 100.

According to an embodiment of the disclosure, the integrated controller of the user interface device 100 may identify the priorities of the first operation course and the second operation course.

The priorities of the first operation course and the second operation course may have been set in advance.

According to an embodiment of the disclosure, an algorithm and/or a lookup table for identifying the priorities of the first operation course and the second operation course may have been stored in at least one of the memory 25 of the first controller 23, the memory 99 of the second controller 97, or a memory of the integrated controller included in the user interface device 100.

At least one of the first controller 23, the second controller 97, or the integrated controller included in the user interface device 100 may identify the priorities of the first operation course and the second operation course based on a lookup table to which priorities of a plurality of operation courses capable of being performed by the first clothes treating apparatus 10 and the second clothes treating apparatus 60 are mapped.

FIG. 16 is a lookup table showing an example of a priority list for operation courses of a clothes treating system according to an embodiment of the disclosure.

Referring to FIG. 16, priorities for operation courses of the clothes treating system 1 may be set according to purposes of the operation courses.

For example, the specialized courses, such as the energy saving course, the time saving course, and the low noise course, according to a user's special needs may have lower priorities than the normal courses (for example, the delicate clothes course and the standard course).

A priority of a first specialized course among the plurality of specialized courses may be higher than a priority of a second specialized course. For example, a priority of the energy saving course may be higher than a priority of the time saving course.

According to various embodiments of the disclosure, a priority of a first specialized course of the first clothes treating apparatus 10 may be different from a priority of a first specialized course of the second clothes treating apparatus 60.

For example, a priority of the energy saving course of the first clothes treating apparatus 10 may be higher than a priority of the energy saving course of the second clothes treating apparatus 60.

However, the priority of the energy saving course of the first clothes treating apparatus 10 may be equal to the priority of the energy saving course of the second clothes treating apparatus 60.

A priority of a first normal course among the plurality of normal courses may be higher than a priority of a second normal course. For example, a priority of the delicate clothes course may be higher than a priority of the standard course.

According to various embodiments of the disclosure, a priority of a first normal course of the first clothes treating apparatus 10 may also be different from a priority of a first normal course of the second clothes treating apparatus 60.

For example, a priority of a delicate clothes course of the first clothes treating apparatus 10 may be higher than a priority of a delicate clothes course of the second clothes treating apparatus 60.

However, the priority of the delicate clothes course of the first clothes treating apparatus 10 may be equal to the priority of the delicate clothes course of the second clothes treating apparatus 60.

Priorities of a plurality of courses that are executable in the first clothes treating apparatus 10 and a plurality of courses that are executable in the second clothes treating apparatus 60 are not limited to the above-described examples, and priorities of the plurality of courses that may be performed by the clothes treating system 1 may have been set in advance according to a designer's intention.

According to various embodiments of the disclosure, a user may set priorities of the plurality of courses that may be performed by the clothes treating system 1 through the user interface device 100.

There may be a case in which a certain course has a special purpose that may be not achieved upon a change of an algorithm of the certain course. In this case, the certain course may be set to have a high priority according to a designer's intention.

According to an embodiment of the disclosure, a preset priority of the first operation course may be equal to a preset priority of the second operation course.

According to an embodiment of the disclosure, the clothes treating system 1 may identify the priorities of the first operation course and the second operation course based on a start time of an operation corresponding to the first operation course and a start time of the second operation course.

For example, in a case in which the preset priority of the first operation course is equal to the preset priority of the second operation course, the priorities may be identified based on a start time of an operation corresponding to the first operation course and a start time of the second operation course.

Figure 17A:
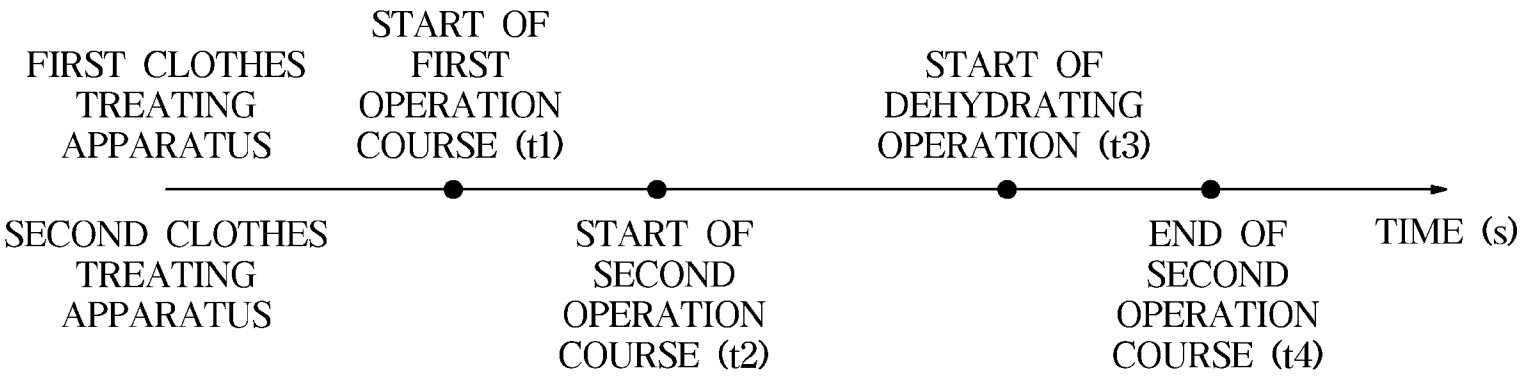
FIGS. 17A and 17B are views for describing an example of a method for setting the same priorities of a first operation course and a second operation course to different priorities according to an embodiment of the disclosure.
Figure 17B:
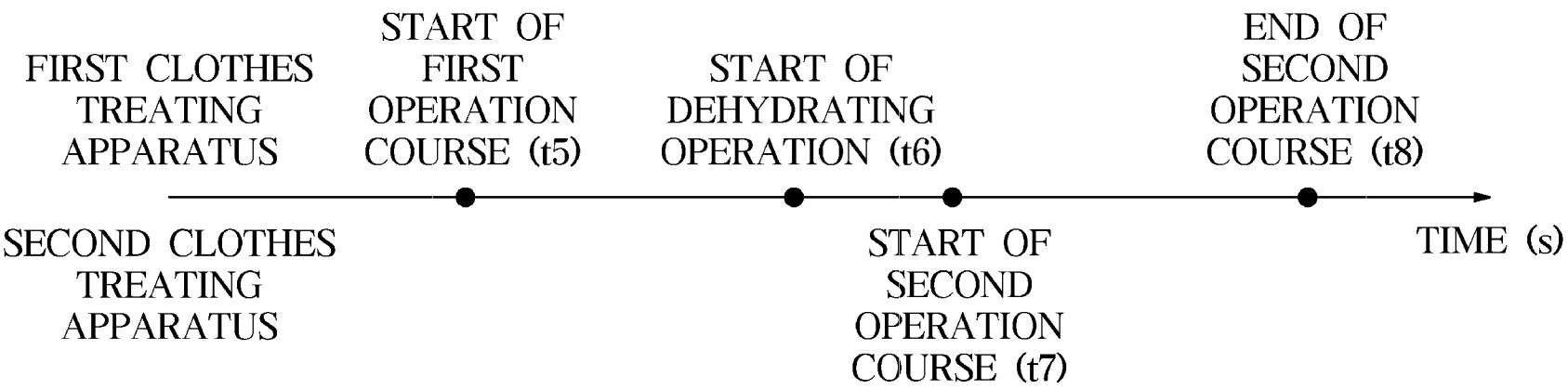

FIGS. 17A and 17B are views for describing an example of a method for setting the same priorities of a first operation course and a second operation course to different priorities.

According to an embodiment of the disclosure, in a case in which a preset priority of a first operation course is equal to a preset priority of a second operation course, the clothes treating system 1 may identify priorities of the first operation course and the second operation course based on a start time of a dehydrating operation corresponding to the first operation course and a start time of the second operation course.

Referring to FIG. 17A, the first clothes treating apparatus 10 may start the first operation course by receiving a start command for the first operation course at a first time t1, and the second clothes treating apparatus 60 may start the second operation course by receiving a start command for the second operation course at a second time t2 that is later than the first time t1.

Under an assumption that a preset priority of the first operation course is equal to a preset priority of the second operation course, in a case in which a start time t3 of a dehydrating operation of the first operation course is later than the second time t2, the clothes treating system 1 may identify that the priority of the second operation course is higher than the priority of the first operation course.

For example, the first controller 23 may recognize a start time t3 of a dehydrating operation according to an algorithm of the first operation course, recognize a start time t2 of the second operation course based on information about the second operation course received through the first communicator 19, and identify that a priority of the second operation course is higher than a priority of the first operation course in response to identification that the start time t3 of the dehydrating operation is later than the start time t2 of the second operation course.

As another example, the second controller 97 may recognize a start time t2 of the second operation course, recognize a start time t3 of a dehydrating operation of the first operation course based on information about the first operation course received through the second communicator 94, and identify that a priority of the second operation course is higher than a priority of the first operation course in response to identification that the start time t3 of the dehydrating operation is later than the start time t2 of the second operation course.

The clothes treating system 1 may change the algorithm of the first operation course, identified to have the lower priority, without changing an algorithm of the second operation course.

Thereafter, the clothes treating system 1 may restore the algorithm of the first operation course at a time t4 at which the second clothes treating apparatus 60 completes the second operation course.

According to various embodiments of the disclosure, in a case in which a priority of the first operation course is equal to a priority of the second operation course, the clothes treating system 1 may change the algorithm of the first operation course according to identification that operation RPM of the first drum motor 41 is smaller than a preset value.

Referring to FIG. 17B, the first clothes treating apparatus 10 may start a first operation course by receiving a start command for the first operation course at a fifth time t5, and enter a dehydrating operation at a sixth time t6.

The second clothes treating apparatus 60 may start a second operation course by receiving a start command for the second operation course at a seventh time t7 that is later than the sixth time t6.

Under an assumption that a preset priority of the first operation course is equal to a preset priority of the second operation course, in a case in which the time t6 at which the dehydrating operation of the first operation course starts is earlier than the seventh time t7, the clothes treating system 1 may identify that a priority of the first operation course is higher than a priority of the second operation course.

For example, the first controller 23 may recognize a time t6 at which a dehydrating operation starts according to an algorithm of the first operation course, recognize a start time t7 of the second operation course based on information about the second operation course, received through the first communicator 19, and identify that a priority of the first operation course is higher than a priority of the second operation course in response to identification that the start time t6 of the dehydrating operation is earlier than the start time t7 of the second operation course.

As another example, the second controller 97 may recognize a start time t7 of the second operation course, recognize a start time t6 of a dehydrating operation of the first operation course, based on information about the first operation course, received through the second communicator 94, and identify that a priority of the first operation course is higher than a priority of the second operation course, in response to identification that the start time t6 of the dehydrating operation is earlier than the start time t7 of the second operation course.

The clothes treating system 1 may change the algorithm of the second operation course, identified to have the lower priority, without changing the algorithm of the first operation course.

Thereafter, the clothes treating system 1 may restore the algorithm of the second operation course at a time t8 at which the first clothes treating apparatus 10 completes the second operation course.

According to various embodiments of the disclosure, in a case in which a priority of the first operation course is equal to a priority of the second operation course, the clothes treating system 1 may change the algorithm of the second operation course according to identification that operation RPM of the first drum motor 41 is greater than or equal to a preset value.

The clothes treating system 1 may change the algorithm of the first operation course or the algorithm of the second operation course based on the priorities of the first operation course and the second operation course (operation 1300).

For example, the clothes treating system 1 may change the algorithm of the first operation course in response to identification that a priority of the first operation course is lower than a priority of the second operation course.

As another example, the clothes treating system 1 may change the algorithm of the second operation course in response to identification that a priority of the second operation course is lower than a priority of the first operation course.

According to various embodiments of the disclosure, in a case in which a preset condition is not satisfied although a priority of the first operation course is different from a priority of the second operation course, the clothes treating system 1 may change neither the algorithms of the first operation course nor the second operation course.

Changing the algorithm of the first operation course or the algorithm of the second operation course based on priorities may include preferentially changing the algorithm of the first operation course or the algorithm of the second operation course upon satisfaction of a preset condition.

The preset condition may include a condition under which there is a risk that a great vibration will occur in the clothes treating system 1 by frequency resonance while the first clothes treating apparatus 10 controls a plurality of electronic components according to the algorithm of the first operation course and the second clothes treating apparatus 60 controls a plurality of electronic components according to the algorithm of the second operation course.

For example, the preset condition may include a condition under which target RPM of the first drum motor 41 according to the algorithm of the first operation course and target RPM of the fan motor 91 according to the algorithm of the second operation course are in an integer multiple relationship.

As another example, the preset condition may include a condition under which target RPM of the first drum motor 41 according to the algorithm of the first operation course and target RPM of the second drum motor 73*a* according to the algorithm of the second operation course are in an integer multiple relationship.

As another example, the preset condition may include a condition under which target RPM of the first drum motor 41 according to the algorithm of the first operation course and target RPM of the compressor 83 according to the algorithm of the second operation course are in an integer multiple relationship.

The target RPM of the first drum motor 41 according to the algorithm of the first operation course may be maximum target RPM of the first drum motor 41 in a first dehydrating operation 1031 and/or a second dehydrating operation 1032.

According to various embodiments of the disclosure, the target RPM of the first drum motor 41 may correspond to an RPM command ω* that is calculated in real time by the first controller 23.

The target RPM of the fan motor 91 according to the algorithm of the second operation course may be target RPM of the fan motor 91 in a drying operation.

According to various embodiments of the disclosure, the target RPM of the fan motor 91 may correspond to an RPM command of the fan motor 91, which is calculated in real time by the second controller 97.

The target RPM of the second drum motor 73*a* according to the algorithm of the second operation course may be target RPM of the second drum motor 73*a* in a drying operation.

According to various embodiments of the disclosure, the target RPM of the second drum motor 73*a* may correspond to an RPM command of the second drum motor 73*a*, which is calculated in real time by the second controller 97.

The target RPM of the compressor 83 according to the algorithm of the second operation course may be target RPM of the compressor 83 in a drying operation.

According to various embodiments of the disclosure, the target RPM of the compressor 83 may correspond to an RPM command of the compressor 83, which is calculated in real time by the second controller 97.

The second controller 97 may transfer information about a RPM command of the compressor 83, an RPM command of the second drum motor 73*a*, and/or an RPM command of the fan motor 91, which are calculated in real time, to the first controller 23. The first controller 23 may transfer information about maximum target RPM of the first drum motor 41 to the second controller 97.

The first controller 23 and/or the second controller 97 may identify whether to change the algorithm of the first operation course or the algorithm of the second operation course, based on the information about the maximum target RPM of the first drum motor 41 and the information about the RPM command of the compressor 83, the RPM command of the second drum motor 73*a*, and/or the RPM command of the fan motor 91, which are calculated in real time. Also, the first controller 23 and/or the second controller 97 may identify a method for changing the algorithm of the first operation course or the algorithm of the second operation course, based on the information about the maximum target RPM of the first drum motor 41 and the information about the RPM command of the compressor 83, the RPM command of the second drum motor 73*a*, and/or the RPM command of the fan motor 91, which are calculated in real time.

A condition under which excessive vibrations are generated in the clothes treating system 1 may be a condition under which the first drum 30 rotates at high speed, and correspond to a condition in which the first clothes treating apparatus 10 performs a dehydrating operation.

According to the disclosure, by changing a course algorithm of a clothes treating apparatus that performs a course having a lower priority to prevent a frequency resonance phenomenon while the first clothes treating apparatus 10 and the second clothes treating apparatus 60 operate simultaneously, it may be possible to achieve a purpose of a course having a higher priority while reducing generation of excessive vibrations.

Figure 18:
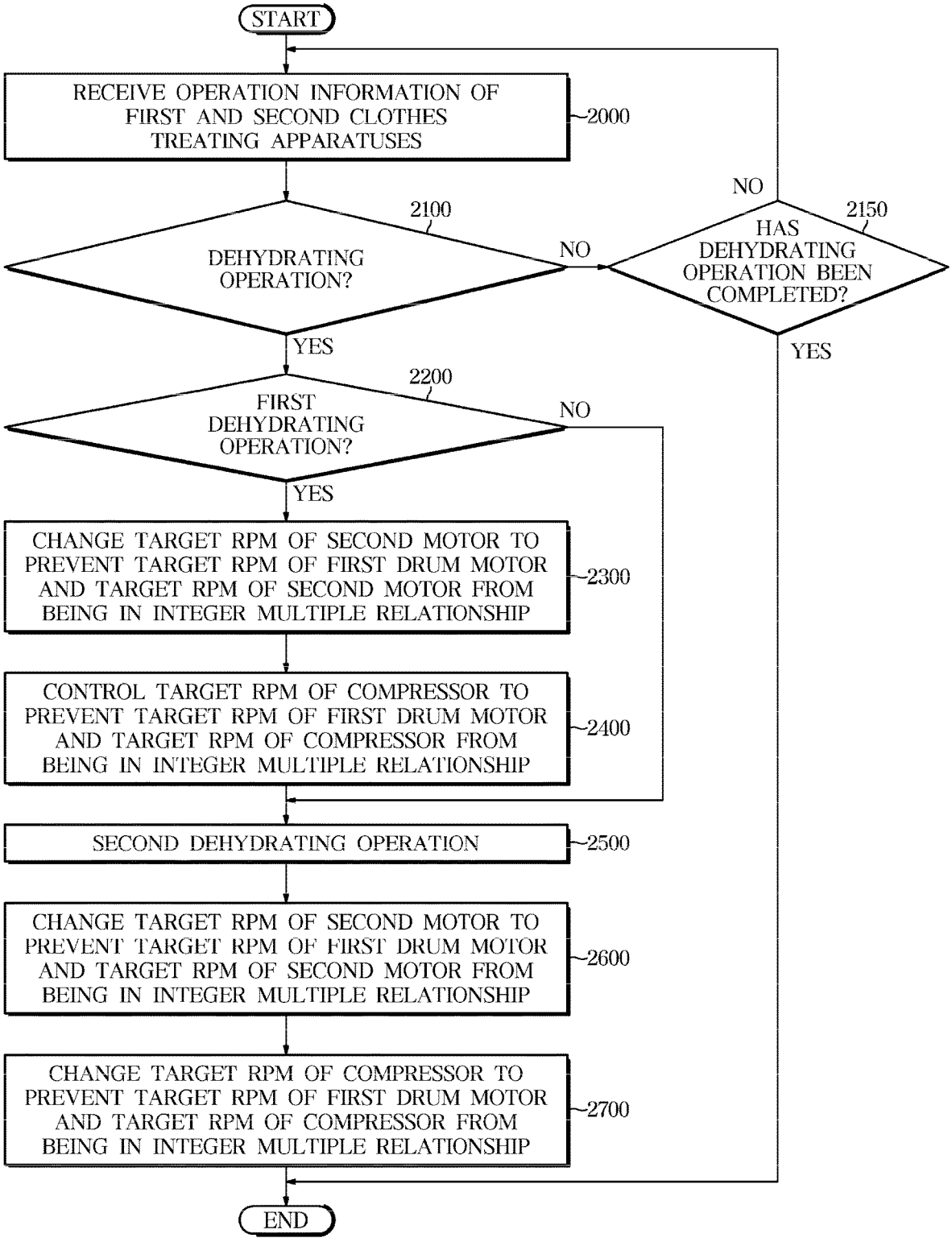
FIG. 18 shows an example of a method for controlling a clothes treating system according to an embodiment of the disclosure while a priority of a first operation course is higher than a priority of a second operation course.

FIG. 18 shows an example of a method for controlling a clothes treating system according to an embodiment of the disclosure in a case in which a priority of a first operation course is higher than a priority of a second operation course.

A method for controlling the clothes treating system 1 in a case in which a priority of a first operation course is higher than a priority of a second operation course will be described with reference to FIG. 18.

The clothes treating system 1 may receive operation information of the first clothes treating apparatus 10 and operation information of the second clothes treating apparatus 60 (operation 2000).

An object that performs the control method shown in FIG. 18 may be the first controller 23 and/or the second controller 97, or may be an integrated controller included in a user interface device.

The clothes treating system 1 may identify whether the first clothes treating apparatus 10 performs a dehydrating operation 1030 according to a first operation course, based on the operation information of the first clothes treating apparatus 10 (operation 2100).

According to identification that the first clothes treating apparatus 10 does not perform the dehydrating operation 1030 according to the first operation course (NO in operation 2100) and a dehydrating operation has been completed (YES in operation 2150), the second clothes treating apparatus 60 may perform an operation corresponding to a second operation course without changing an algorithm of the second operation course.

While the first clothes treating apparatus 10 performs a first dehydrating operation 1031 in the dehydrating operation 1030 according to the first operation course (YES in operation 2200), the clothes treating system 1 may change operation RPM of a plurality of electronic components of the second clothes treating apparatus 60 to prevent target RPM J1 (see FIG. 10) of the first drum motor 41 and operation RPM of a plurality of electronic components of the second clothes treating apparatus 60 according to the second operation course from being in an integer multiple relationship (operations 2300 and 2400).

According to the disclosure, by changing only the operation RPM of the plurality of electronic components of the second clothes treating apparatus 60 without changing the target RPM J1 of the first drum motor 41, it may be possible to prevent excessive vibrations from being generated in the clothes treating system 1 due to satisfaction of a resonance condition caused because the RPM of the first drum motor 41 and the operation RPM of the plurality of electronic components of the second clothes treating apparatus 60 are in an integer multiple relationship.

According to an embodiment of the disclosure, the clothes treating system 1 may control target RPM of the second motor 91 and 73*a* of the second clothes treating apparatus 60 to prevent the target RPM J1 (see FIG. 10) of the first drum motor 41 and target RPM of the fan motor 91 and/or the second drum motor 73*a* (hereinafter, also referred to as a 'second motor 91 and 73*a*') of the second clothes treating apparatus 60 according to the second operation course from being in an integer multiple relationship (operation 2300).

For example, while target RPM J1 of the first drum motor 41 is 500 RPM and target RPM of the second motor 91 and 73*a* of the second clothes treating apparatus 60 according to the algorithm of the second operation course is 2500 RPM, the clothes treating system 1 may change the algorithm of the second operation course such that target RPM of the second motor 91 and 73*a* of the second clothes treating apparatus 60 is greater or smaller than 2500 RPM by a preset value.

According to an embodiment of the disclosure, the clothes treating system 1 may control target RPM of the compressor 83 of the second clothes treating apparatus 60 to prevent the target RPM J1 (see FIG. 10) of the first drum motor 41 and target RPM of the compressor 83 of the second clothes treating apparatus 60 according to the second operation course from being in an integer multiple relationship (operation 2400).

For example, while target RPM J1 of the first drum motor 41 is 600 RPM and target RPM of the compressor 83 of the second clothes treating apparatus 60 according to the algorithm of the second operation course is 1800 RPM (=30 Hz), the clothes treating system 1 may change the algorithm of the second operation course such that target RPM of the compressor 83 of the second clothes treating apparatus 60 is greater or smaller than 1800 RPM by a preset value.

According to various embodiments of the disclosure, target RPM of the compressor 83 may be regulated in real time according to target temperature set according to the algorithm of the second operation course.

According to an embodiment of the disclosure, changing the algorithm of the second operation course such that target RPM of the compressor 83 is greater or smaller than a preset value may include changing the algorithm of the second operation course such that target RPM of the compressor 83 is greater than the preset value in response to identification that temperature detected through the sensor 79 is lower than target temperature set according to the algorithm of the second operation course, and changing the algorithm of the second operation course such that target RPM of the compressor 83 is smaller than the preset value in response to identification that temperature detected through the sensor 79 is higher than target temperature set according to the algorithm of the second operation course.

Temperature detected through the sensor 79 may correspond to inside temperature of the second clothes treating apparatus 60, and may correspond to temperature at the exit of the condenser 82.

According to the disclosure, by changing target RPM of the compressor 83 according to a difference between target temperature and actual temperature, a resonance phenomenon may be prevented while the second clothes treating apparatus 60 follows the target temperature at higher speed.

While the first clothes treating apparatus 10 performs a second dehydrating operation 1032 in the dehydrating operation 1030 according to the first operation course (operation 2500), the clothes treating system 1 may change operation RPM of the plurality of electronic components of the second clothes treating apparatus 60 to prevent target RPM J2 (see FIG. 10) of the first drum motor 41 and operation RPM of the plurality of electronic components of the second clothes treating apparatus 60 according to the second operation course from being in an integer multiple relationship (operations 2600 and 2700).

According to an embodiment of the disclosure, the clothes treating system 1 may control target RPM of the second motor 91 and 73*a* of the second clothes treating apparatus 60 to prevent the target RPM J2 (see FIG. 10) of the first drum motor 41 and target RPM of the second motor 91 and 73*a* of the second clothes treating apparatus 60 according to the second operation course from being in an integer multiple relationship (operation 2600).

For example, while target RPM of the first drum motor 41 is 1000 RPM and target RPM of the second motor 91 and 73*a* of the second clothes treating apparatus 60 according to the algorithm of the second operation course is 2000 RPM, the clothes treating system 1 may change the algorithm of the second operation course to down-regulate the target RPM of the second motor 91 and 73*a* of the second clothes treating apparatus 60 to be lower than 2000 RPM by a preset value.

According to an embodiment of the disclosure, the clothes treating system 1 may control the target RPM of the compressor 83 of the second clothes treating apparatus 60 to prevent the target RPM J2 (see FIG. 10) of the first drum motor 41 and target RPM of the compressor 83 of the second clothes treating apparatus 60 according to the second operation course from being in an integer multiple relationship (operation 2700).

For example, while target RPM of the first drum motor 41 is 1200 RPM and target RPM of the compressor 83 of the second clothes treating apparatus 60 according to the algorithm of the second operation course is 3600 RPM (=60 Hz), the clothes treating system 1 may change the algorithm of the second operation course such that target RPM of the compressor 83 of the second clothes treating apparatus 60 is greater or smaller than 3600 RPM by a preset value.

According to various embodiments of the disclosure, target RPM of the compressor 83 may be regulated in real time according to target temperature set according to the algorithm of the second operation course.

According to an embodiment of the disclosure, changing the algorithm of the second operation course such that target RPM of the compressor 83 is greater or smaller than a preset value may include changing the algorithm of the second operation course such that target RPM of the compressor 83 is greater than the preset value in response to identification that temperature detected through the sensor 79 is lower than target temperature set according to the algorithm of the second operation course, and changing the algorithm of the second operation course such that target RPM of the compressor 83 is smaller than the preset value in response to identification that temperature detected through the sensor 79 is higher than target temperature set according to the algorithm of the second operation course.

According to an embodiment of the disclosure, operations 2300, 2400, 2600, and 2700 may be performed in a case in which target RPM of the first drum motor 41 and operation RPM of the plurality of electronic components of the second clothes treating apparatus 60 belong to a range in which a resonance phenomenon may occur, as well as in a case in which target RPM of the first drum motor 41 and operation RPM of the plurality of electronic components of the second clothes treating apparatus 60 are exactly in an integer multiple relationship.

That is, the second clothes treating apparatus 60 may regulate operation RPM of the plurality of electronic components such that target RPM of the first drum motor 41 and operation RPM of the plurality of electronic components of the second clothes treating apparatus 60 do not belong to a preset range corresponding to an integer multiple relationship.

For example, while target RPM of the first drum motor 41 is 1200 RPM and target RPM of the compressor 83 of the second clothes treating apparatus 60 according to the algorithm of the second operation course is 3540 RPM (=59 Hz), the clothes treating system 1 may change the algorithm of the second operation course such that target RPM of the compressor 83 of the second clothes treating apparatus 60 is smaller than 3540 RPM by a preset value.

As another example, for example, while target RPM of the first drum motor 41 is 1200 RPM and target RPM of the compressor 83 of the second clothes treating apparatus 60 according to the algorithm of the second operation course is 3660 RPM (=61 Hz), the clothes treating system 1 may change the algorithm of the second operation course such that target RPM of the compressor 83 of the second clothes treating apparatus 60 is smaller than 3660 RPM by a preset value.

Figure 19:
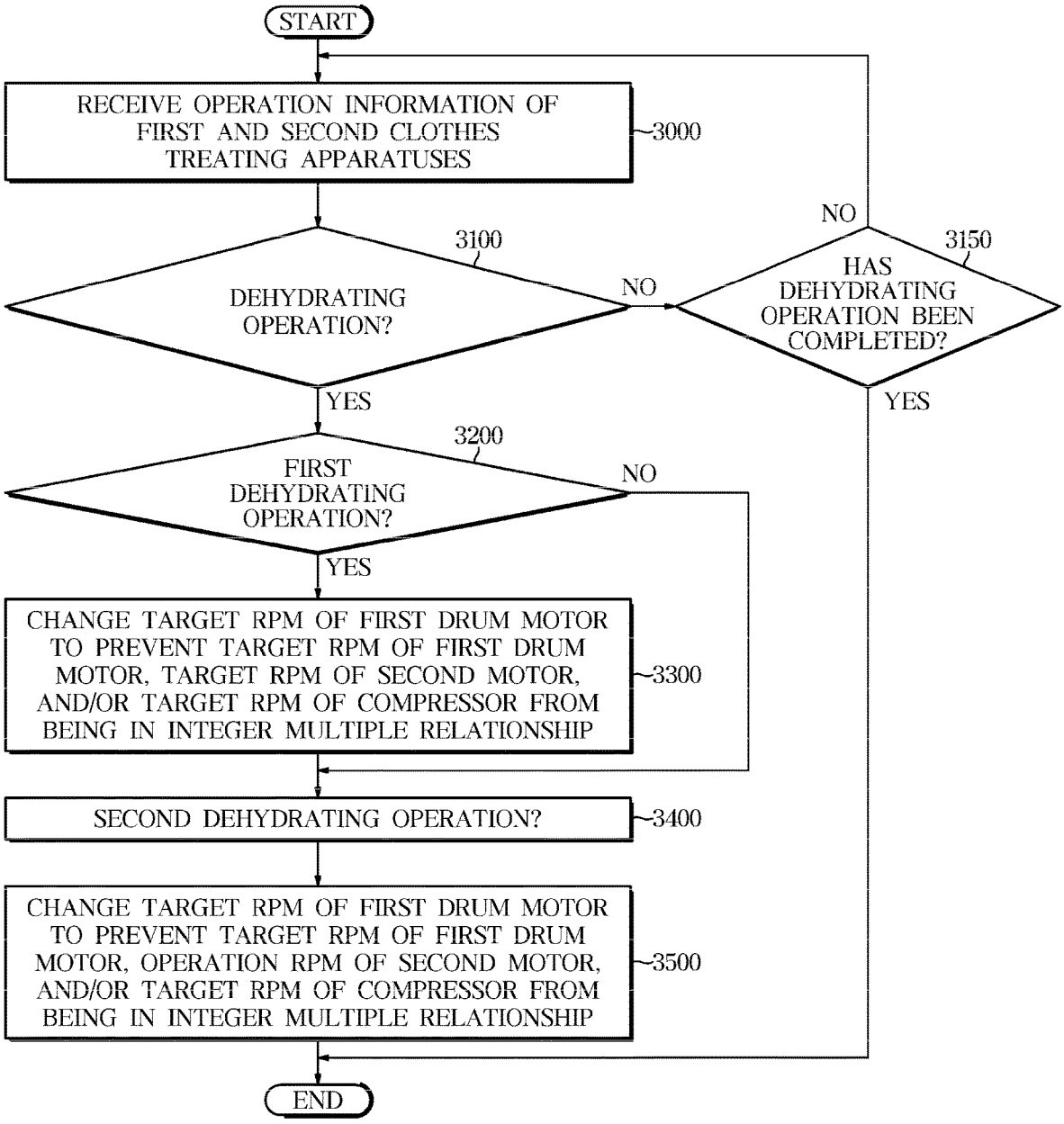
FIG. 19 shows an example of a method for controlling a clothes treating system according to an embodiment of the disclosure while a priority of a second operation course is higher than a priority of a first operation course.

FIG. 19 shows an example of a method for controlling a clothes treating system according to an embodiment of the disclosure in a case in which a priority of a second operation course is higher than a priority of a first operation course.

The method for controlling the clothes treating system 1 in a case in which a priority of the second operation course is higher than a priority of the first operation course will be described with reference to FIG. 19.

The clothes treating system 1 may receive operation information of the first clothes treating apparatus 10 and operation information of the second clothes treating apparatus 60 (operation 3000).

An object that performs the control method shown in FIG. 19 may be the first controller 23 and/or the second controller 97, or may be an integrated controller included in a user interface device.

The clothes treating system 1 may identify whether the first clothes treating apparatus 10 performs a dehydrating operation 1030 according to the first operation course, based on the operation information of the first clothes treating apparatus 10 (operation 3100).

According to identification that the first clothes treating apparatus 10 does not perform the dehydrating operation 1030 according to the first operation course (NO in operation 3100) and a dehydrating operation has been completed (YES in operation 3150), the first clothes treating apparatus 10 may perform an operation corresponding to the first operation course without changing an algorithm of the first operation course.

While the first clothes treating apparatus 10 performs a first dehydrating operation 1031 in the dehydrating operation 1030 according to the first operation course (YES in operation 3200), the clothes treating system 1 may change target RPM J1 (see FIG. 10) of the first drum motor 41 of the first clothes treating apparatus 10 to prevent target RPM J1 of the first drum motor 41 and operation RPM of a plurality of electronic components of the second clothes treating apparatus 60 according to the second operation course from being in an integer multiple relationship (operation 3300).

According to an embodiment of the disclosure, the clothes treating system 1 may change the target RPM J1 of the first drum motor 41 to prevent the target RPM J1 of the first drum motor 41 and target RPM of the second motor 91 and 73*a* according to the second operation course from being in an integer multiple relationship.

For example, while target RPM J1 of the first drum motor 41 is 500 RPM and target RPM of the second motor 91 and 73*a* of the second clothes treating apparatus 60 according to an algorithm of the second operation course is 2500 RPM, the clothes treating system 1 may change the algorithm of the first operation course such that target RPM J1 of the first drum motor 41 is greater or smaller than 500 RPM by a preset value.

According to an embodiment of the disclosure, the clothes treating system 1 may change the target RPM J1 of the first drum motor 41 to prevent the target RPM J1 (see FIG. 10) of the first drum motor 41 and target RPM of the compressor 83 according to the second operation course from being in an integer multiple relationship.

For example, while target RPM J1 of the first drum motor 41 is 600 RPM and target RPM of the compressor 83 of the second clothes treating apparatus 60 according to the algorithm of the second operation course is 2400 RPM (=40 Hz), the clothes treating system 1 may change the algorithm of the first operation course such that target RPM J1 of the first drum motor 41 is greater or smaller than 600 RPM by a preset value.

According to the disclosure, by changing only target RPM of the first drum motor 41 without changing operation RPM of the plurality of electronic components of the second clothes treating apparatus 60, it may be possible to prevent excessive vibrations from being generated in the clothes treating system 1 because the RPM of the first drum motor 41 and the operation RPM of the plurality of electronic components of the second clothes treating apparatus 60 are in an integer multiple relationship.

While the first clothes treating apparatus 10 performs a second dehydrating operation 1032 in the dehydrating operation 1030 according to the first operation course (operation 3400), the clothes treating system 1 may change target RPM J2 of the first drum motor 41 of the first clothes treating apparatus 10 to prevent the target RPM J2 (see FIG. 10) of the first drum motor 41 and the operation RPM of the plurality of electronic components of the second clothes treating apparatus 60 according to the second operation course from being in an integer multiple relationship (operation 3500).

According to an embodiment of the disclosure, the clothes treating system 1 may change the target RPM J2 of the first drum motor 41 to prevent the target RPM J2 of the first drum motor 41 and target RPM of the second motor 91 and 73*a* according to the second operation course from being in an integer multiple relationship.

For example, while target RPM of the first drum motor 41 is 1000 RPM and target RPM of the second motor 91 and 73*a* of the second clothes treating apparatus 60 according to the algorithm of the second operation course is 2000 RPM, the clothes treating system 1 may change the algorithm of the first operation course such that the target RPM of the first drum motor 41 increases or decreases by a preset value.

According to an embodiment of the disclosure, the clothes treating system 1 may change the target RPM J2 of the first drum motor 41 to prevent the target RPM J2 of the first drum motor 41 and target RPM of the compressor 83 according to the second operation course from being in an integer multiple relationship.

For example, while target RPM of the first drum motor 41 is 1200 RPM and target RPM of the compressor 83 of the second clothes treating apparatus 60 according to the algorithm of the second operation course is 3600 RPM (=60 Hz), the clothes treating system 1 may change the algorithm of the second operation course such that the target RPM J2 of the first drum motor 41 increases or decreases by a preset value.

According to an embodiment of the disclosure, operations 3300 and 3500 may be performed in a case in which target RPM of the first drum motor 41 and operation RPM of the plurality of electronic components of the second clothes treating apparatus 60 belong to a range in which a resonance phenomenon may occur, as well as in a case in which target RPM of the first drum motor 41 and operation RPM of the plurality of electronic components of the second clothes treating apparatus 60 are exactly in an integer multiple relationship.

That is, the second clothes treating apparatus 60 may regulate the target RPM of the first drum motor 41 such that the target RPM of the first drum motor 41 and the operation RPM of the plurality of electronic components of the second clothes treating apparatus 60 do not correspond to a preset range corresponding to an integer multiple relationship.

For example, while target RPM of the first drum motor 41 is 1200 RPM and target RPM of the compressor 83 of the second clothes treating apparatus 60 according to the algorithm of the second operation course is 3540 RPM (=59 Hz), the clothes treating system 1 may change the algorithm of the first operation course such that target RPM of the first drum motor 41 is greater than 1200 RPM by a preset value.

As another example, for example, while target RPM of the first drum motor 41 is 1200 RPM and target RPM of the compressor 83 of the second clothes treating apparatus 60 according to the algorithm of the second operation course is 3660 RPM (=61 Hz), the clothes treating system 1 may change the algorithm of the first operation course such that target RPM of the compressor 83 of the second clothes treating apparatus 60 is smaller than 1200 RPM by a preset value.

Figure 20:
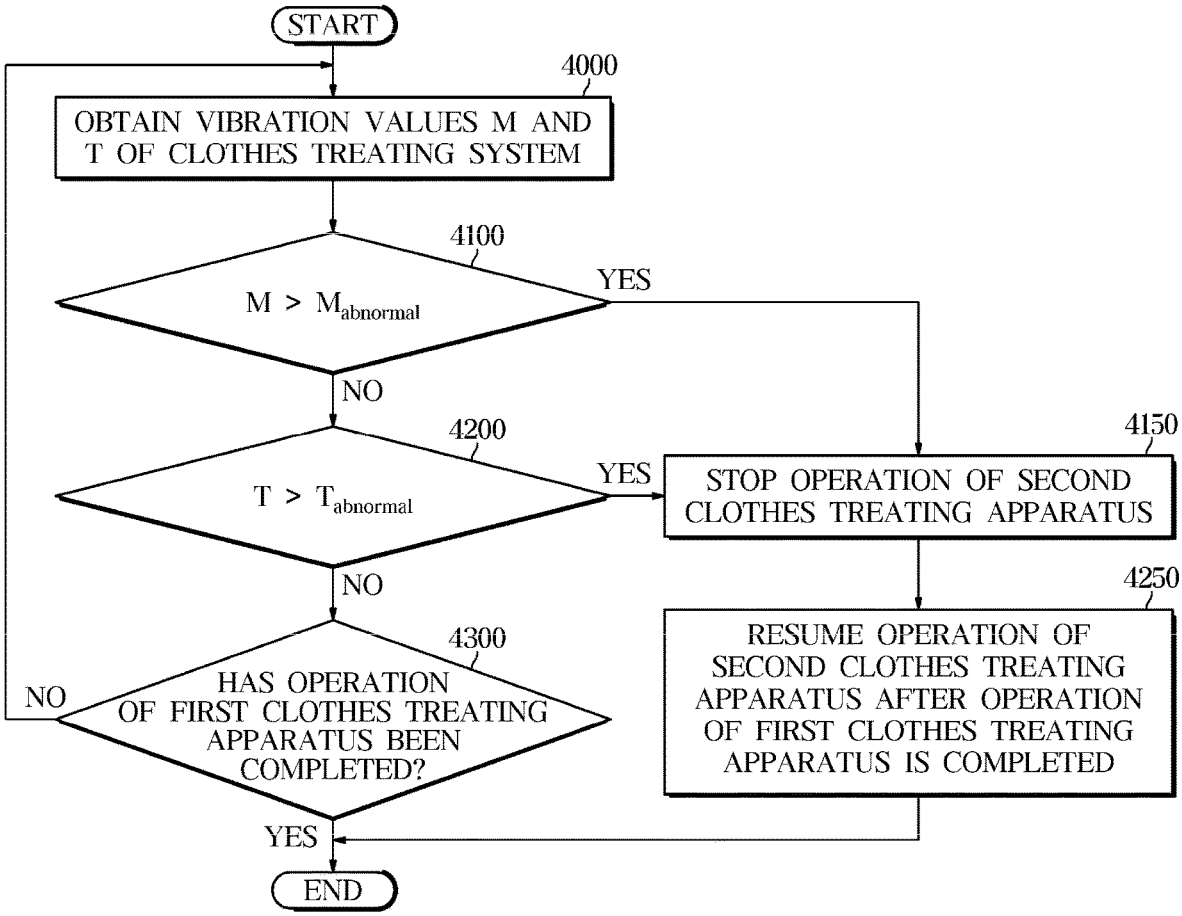
FIG. 20 is a flowchart showing an example of a method for controlling a clothes treating system according to an embodiment of the disclosure.

FIG. 20 is a flowchart showing an example of a method for controlling a clothes treating system according to an embodiment of the disclosure.

An object that performs the control method shown in FIG. 20 may be the first controller 23 and/or the second controller 97, or may be an integrated controller included in a user interface device.

In various situations, abnormal vibrations may be generated in the clothes treating system 1 although RPM of the first drum motor 41 and operation RPM of a plurality of electronic components of the second clothes treating apparatus 60 are not in a resonance relation.

Referring to FIG. 20, the clothes treating system 1 may obtain vibration values M and T of vibrations generated in the clothes treating system 1 (operation 4000).

According to an embodiment of the disclosure, the sensor 18 of the first clothes treating apparatus 10 and/or the sensor 79 of the second clothes treating apparatus 60 may include at least one vibration sensor.

The at least one vibration sensor may include an acceleration sensor and/or a torque sensor. The acceleration sensor may be installed in the tub 20, although not limited thereto.

For example, the acceleration sensor may be installed in the first housing 11 and/or the second housing 61.

The torque sensor may be installed in the first driver 40 and/or the second driver 73, although not limited thereto.

The vibration values M and T of the vibrations generated in the clothes treating system 1 may be obtained by the sensors 18 and 79.

The vibration values M and T may include a first vibration value M obtained from the acceleration sensor and/or a second vibration value T obtained from the torque sensor.

According to an embodiment of the disclosure, in a case in which the sensors 18 and 79 include both an acceleration sensor and a torque sensor, the clothes treating system 1 may identify abnormal vibrations of the clothes treating system 1 by using both a first vibration value M and a second vibration value T.

According to an embodiment of the disclosure, in a case in which the sensors 18 and 79 include only torque sensors, the clothes treating system 1 may identify abnormal vibrations of the clothes treating system 1 by using second vibration values T.

The clothes treating system 1 may identify whether the first vibration value M is greater than a first threshold value $m_{abnormal}$ (operation 4100).

According to an embodiment of the disclosure, according to identification that a state in which the first vibration value M is greater than the first threshold value $M_{abnormal}$ is maintained for a preset time (for example, 10 seconds), the clothes treating system 1 may identify that the first vibration value M is greater than the first threshold value $M_{abnormal}$.

The clothes treating system 1 may identify whether the second vibration value T is greater than a second threshold value $T_{abnormal}$ (operation 4200).

According to an embodiment of the disclosure, according to identification that a state in which the second vibration value T is greater than the second threshold value $T_{abnormal}$ is maintained for a preset time (for example, 10 seconds), the clothes treating system 1 may identify that the second vibration value T is greater than the second threshold value $T_{abnormal}$.

The clothes treating system 1 may stop an operation of the second clothes treating apparatus 60 in response to identification (YES in operation 4100) that the first vibration value M is greater than the first threshold value $M_{abnormal}$ or identification (YES in operation 4200) that the second vibration value T is greater than the second threshold value $T_{abnormal}$ (operation 4150).

According to the disclosure, by preferentially stopping an operation of the second clothes treating apparatus 60 according to generation of abnormal vibrations in the clothes treating apparatus 1, components of the clothes treating system 1 may be prevented from being damaged.

According to various embodiments of the disclosure, the clothes treating system 1 may omit a dehydrating operation in a first operation course in response to identification (YES in operation 4100) that the first vibration value M is greater than the first threshold value $M_{abnormal}$ or identification (YES in operation 4200) that the second vibration value T is greater than the second threshold value $T_{abnormal}$.

For example, according to identification that a first vibration value M is greater than the first threshold value $M_{abnormal}$ or a second vibration value T is greater than the second threshold value $T_{abnormal}$ while the clothes treating system 1 performs a midway dehydrating operation 1015 of a washing operation 1010, the clothes treating system 1 may control the first clothes treating apparatus 10 to perform only remaining operations except for dehydrating operations 1015, 1024, and 1030.

According to the disclosure, by performing a clothes treating cycle while omitting an operation in which abnormal vibrations may be generated in the first clothes treating apparatus 10, regeneration of abnormal vibrations may be prevented.

The clothes treating system 1 may resume an operation of the second clothes treating apparatus 60 in response to identification that an operation of the first clothes treating apparatus 10 is completed (operation 4250).

According to various embodiments of the disclosure, according to identification that a state in which a first vibration value M is smaller than the first threshold value $M_{abnormal}$ is maintained for a preset time while the clothes treating system 1 controls the first clothes treating apparatus 10 to perform only the remaining operations except for dehydrating operations 1015, 1024, and 1030, the clothes treating system 1 may resume the operation of the second clothes treating apparatus 60.

According to various embodiments of the disclosure, according to identification that a state in which a second vibration value T is smaller than the second threshold value $T_{abnormal}$ is maintained for a preset time while the clothes treating system 1 controls the first clothes treating apparatus 10 to perform only the remaining operations except for dehydrating operations 1015, 1024, and 1030, the clothes treating system 1 may resume the operation of the second clothes treating apparatus 60.

According to various embodiments of the disclosure, according to identification that there is a history in which a first vibration value M is greater than the first threshold value $M_{abnormal}$ or a history in which a second vibration value T is greater than the second threshold value $T_{abnormal}$, the clothes treating system 1 may notify a user that an abnormal vibration has been generated, through the user interface device 100.

Also, according to various embodiments of the disclosure, according to identification that there is a history in which a first vibration value M is greater than the first threshold value $M_{abnormal}$ or a history in which a second vibration value T is greater than the second threshold value $T_{abnormal}$, the clothes treating system 1 may transmit a signal notifying that an abnormal vibration has been generated, to an external device, through the communicators 19 and 94.

According to the disclosure, by omitting some operations of the first clothes treating apparatus 10 and stopping an operation of the second clothes treating apparatus 60 according to identification that an abnormal vibration is generated in the clothes treating system 1, components may be prevented from being damaged.

Also, according to the disclosure, by notifying a user of an abnormal vibration of the clothes treating apparatus 1, dissatisfaction about incomplete clothes treating by the clothes treating system 1 may be more or less mitigated.

According to an embodiment of the disclosure, there is provided a method for controlling a clothes treating system 1 including a first clothes treating apparatus 10 and a second clothes treating apparatus 60 electrically connected to the first clothes treating apparatus 10, the method including: obtaining information about a first operation course of the first clothes treating apparatus 10 and information about a second operation course of the second clothes treating apparatus 60; identifying a priority between the first operation course and the second operation course; and changing an algorithm of the first operation course or an algorithm of the second operation course based on the priority.

The changing of the algorithm of the first operation course or the algorithm of the second operation course based on the priority may include changing the algorithm of the second operation course in response to identification that the first operation course has the priority over the second operation course.

The changing of the algorithm of the first operation course or the algorithm of the second operation course based on the priorities may include changing the algorithm of the first operation course in response to identification that the second operation course has the priority over the first operation course.

The identifying of the priority between the first operation course and the second operation course may include identifying the priority between the first operation course and the second operation course based on a lookup table to which priorities of a plurality of operation courses capable of being performed by the first clothes treating apparatus and the second clothes treating apparatus are mapped.

The first clothes treating apparatus may be a washing machine including a drum motor 41 for rotating a drum 30, and the second clothes treating apparatus may be a dryer including at least one of a compressor 83 or a fan motor 91 for rotating a fan.

The changing of the algorithm of the first operation course may include changing target RPM of the drum motor, corresponding to the first operation course, to prevent the target RPM of the drum motor, corresponding to the first operation course, and target RPM of the fan motor, corresponding to the second operation course, from being in an integer multiple relationship.

The changing of the algorithm of the first operation course may include changing the target RPM of the drum motor, corresponding to the first operation course, to prevent the target RPM of the drum motor, corresponding to the first operation course, and target RPM of the compressor, corresponding to the second operation course, from being in an integer multiple relationship.

The changing of the algorithm of the second operation course may include changing target RPM of the fan motor to prevent the target RPM of the drum motor, corresponding to the first operation course, and the target RPM of the fan motor, corresponding to the second operation course, from being in an integer multiple relationship.

The changing of the algorithm of the second operation course may include changing target RPM of the compressor to prevent the target RPM of the drum motor, corresponding to the first operation course, and the target RPM of the compressor, corresponding to the second operation course, from being in an integer multiple relationship.

The changing of the target RPM of the compressor may include up-regulating the target RPM of the compressor in response to identification that inside temperature of the dryer is lower than target temperature.

The changing of the target RPM of the compressor may include down-regulating the target RPM of the compressor in response to identification that inside temperature of the dryer is higher than the target temperature.

The method for controlling the clothes treating system may further include: obtaining a vibration value of the clothes treating system; and stopping an operation of the second clothes treating apparatus according to identification that the vibration value of the clothes treating system is greater than a preset value.

The method for controlling the clothes treating system may further include resuming the operation of the second clothes treating apparatus in response to operation completion of the first clothes treating apparatus.

The method for controlling the clothes treating system may further include changing the target RPM of the compressor or the target RPM of the fan motor according to identification that the first operation course and the second operation course has the same priority.

The method for controlling the clothes treating system may further include changing, while the first operation course and the second operation course having the same priority, the target RPM of the compressor or the target RPM of the fan motor according to identification that RPM of the drum motor is greater than or equal to a preset value.

The method for controlling the clothes treating system may further include changing, while the first operation course and the second operation course having the same priority, the target RPM of the drum motor according to identification that RPM of the drum motor is smaller than the preset value.

According to an embodiment of the disclosure, there is provided a clothes treating system including: a first clothes treating apparatus including a drum motor configured to rotate a drum, and a first controller configured to control the drum motor; a second clothes treating apparatus including a fan motor configured to rotate a fan, a compressor, and a second controller configured to control the fan motor and the compressor; and a user interface device configured to receive a user input of selecting an operation course of the first clothes treating apparatus and an operation course of the second clothes treating apparatus, wherein the first controller is configured to change an algorithm of the operation course of the first clothes treating apparatus based on a priority between the operation course of the first clothes treating apparatus and the operation course of the second clothes treating apparatus, and the second controller is configured to change an algorithm of the operation course of the second clothes treating apparatus based on the priority between the operation course of the first clothes treating apparatus and the operation course of the second clothes treating apparatus.

The first controller may change the algorithm of the operation course of the first clothes treating apparatus in response to identification that the operation course of the second clothes treating apparatus has the priority over the operation course of the first clothes treating apparatus.

The first controller may change target RPM of the drum motor, corresponding to the operation course of the first clothes treating apparatus, to prevent the target RPM of the drum motor, corresponding to the operation course of the first clothes treating apparatus, and at least one of target RPM of the compressor or target RPM of the fan motor, corresponding to the operation course of the second clothes treating apparatus from being in an integer multiple relationship.

The second controller may change the algorithm of the operation course of the second clothes treating apparatus in response to identification that the operation course of the first clothes treating apparatus has the priority over the operation course of the second clothes treating apparatus.

The second controller may change the target RPM of the fan motor to prevent the target RPM of the fan motor, corresponding to the operation course of the second clothes treating apparatus, from being in an integer multiple relationship with the target RPM of the drum motor, corresponding to the operation course of the first clothes treating apparatus.

The second controller may change the target RPM of the compressor to prevent the target RPM of the compressor, corresponding to the operation course of the second clothes treating apparatus, from being in an integer multiple relationship with the target RPM of the drum motor, corresponding to the operation course of the first clothes treating apparatus.

Meanwhile, the disclosed embodiments may be implemented in the form of a recording medium that stores instructions executable by a computer. The instructions may be stored in the form of program codes, and when executed by a processor, the instructions may create a program module to perform operations of the disclosed embodiments. The recording medium may be implemented as a computer-readable recording medium.

The computer-readable recording medium may include all kinds of recording media storing instructions that can be interpreted by a computer. For example, the computer-readable recording medium may be read only memory (ROM), random access memory (RAM), a magnetic tape, a magnetic disc, a flash memory, an optical data storage device, etc.

Also, the computer-readable recording medium may be provided in the form of a non-transitory storage medium, wherein the term 'non-transitory storage medium' simply means that the storage medium is a tangible device, and does not include a signal (e.g., an electromagnetic wave), but this term does not differentiate between where data is semi-permanently stored in the storage medium and where the data is temporarily stored in the storage medium. For example, a 'non-transitory storage medium' may include a buffer in which data is temporarily stored.

According to an embodiment of the disclosure, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloadable or uploadable) online via an application store (e.g., Play Store™) or between two user devices (e.g., smart phones) directly. When distributed online, at least part of the computer program product (e.g., a downloadable app) may be temporarily generated or at least temporarily stored in the machine-readable storage medium, such as a memory of the manufacturers server, a server of the application store, or a relay server.

So far, the disclosed embodiments have been described with reference to the accompanying drawings. It will be apparent that those skilled in the art can make various modifications thereto without changing the technical spirit and essential features of the present disclosure. Thus, it should be understood that the embodiments described above are merely for illustrative purposes and not for limitation purposes in all aspects.

What is claimed is:

1. A method of controlling a clothes treating system including a first clothes treating apparatus and a second clothes treating apparatus electrically connected to the first clothes treating apparatus, the method comprising:

obtaining information about an operation course of the first clothes treating apparatus and information about an operation course of the second clothes treating apparatus;

identifying a priority between the operation course of the first clothes treating apparatus and the operation course of the second clothes treating apparatus based on the obtained information about the operation course of the first clothes treating apparatus and the obtained information about the operation course of the second clothes treating apparatus; and changing an algorithm of the operation course of the first clothes treating apparatus or an algorithm of the operation course of the second clothes treating apparatus based on the identified priority between the operation course of the first clothes treating apparatus and the operation course of the second clothes treating apparatus.

2. The method of claim 1, wherein the changing the algorithm of the operation course of the first clothes treating apparatus or the algorithm of the operation course of the second clothes treating apparatus includes:

changing the algorithm of the operation course of the second clothes treating apparatus in response to identifying that the operation course of the first clothes treating apparatus has the priority over the operation course of the second clothes treating apparatus.

3. The method of claim 2, wherein the changing the algorithm of the operation course of the first clothes treating apparatus or the algorithm of the operation course of the second clothes treating apparatus includes:

changing the algorithm of the operation course of the first clothes treating apparatus in response to identifying that the operation course of the second clothes treating apparatus has the priority over the operation course of the first clothes treating apparatus.

4. The method of claim 1, wherein the identifying the priority between the operation course of the first clothes treating apparatus and the operation course of the second clothes treating apparatus includes:

identifying the priority between the operation course of the first clothes treating apparatus and the operation course of the second clothes treating apparatus based on a lookup table in which priorities of a plurality of operation courses capable of being performed by the first clothes treating apparatus and the second clothes treating apparatus are mapped.

5. The method of claim 1, wherein the first clothes treating apparatus is a washing machine including:

a drum, and a drum motor to rotate the drum, and the second clothes treating apparatus is a dryer including at least one of:

a compressor, and a fan and a fan motor to rotate the fan.

6. The method of claim 5, wherein the changing the algorithm of the operation course of the first clothes treating apparatus includes:

changing a target revolutions per minute (RPM) of the drum motor, corresponding to the operation course of the first clothes treating apparatus, to prevent the target RPM of the drum motor and a target RPM of the fan motor, corresponding to the operation course of the second clothes treating apparatus, from being in an integer multiple relationship.

7. The method of claim 5, wherein the changing the algorithm of the operation course of the first clothes treating apparatus includes:

changing a target revolutions per minute (RPM) of the drum motor, corresponding to the operation course of the first clothes treating apparatus, to prevent the target RPM of the drum motor and a target RPM of the compressor, corresponding to the operation course of the second clothes treating apparatus, from being in an integer multiple relationship.

8. The method of claim 5, wherein the changing the algorithm of the operation course of the second clothes treating apparatus includes:

changing a target revolutions per minute (RPM) of the fan motor, corresponding to the operation course of the second clothes treating apparatus, to prevent a target RPM of the drum motor, corresponding to the operation course of the first clothes treating apparatus, and the target RPM of the fan motor from being in an integer multiple relationship.

9. The method of claim 5, wherein the changing the algorithm of the operation course of the second clothes treating apparatus includes:

changing a target revolutions per minute (RPM) of the compressor, corresponding to the operation course of the second clothes treating apparatus, to prevent a target RPM of the drum motor, corresponding to the operation course of the first clothes treating apparatus, and the target RPM of the compressor from being in an integer multiple relationship.

10. The method of claim 9, further comprising:

obtaining an inside temperature of the dryer, wherein the changing the target RPM of the compressor includes:

up-regulating the target RPM of the compressor in response to the obtained inside temperature of the dryer being lower than a target temperature, and down-regulating the target RPM of the compressor in response to the obtained inside temperature of the dryer being higher than the target temperature.

11. The method of claim 5, further comprising:

obtaining a vibration value of the clothes treating system; and stopping the operation course of the second clothes treating apparatus in response to the obtained vibration value of the clothes treating system being greater than a preset value.

12. The method of claim 11, further comprising:

resuming the operation course of the second clothes treating apparatus in response to the operation course of the first clothes treating apparatus being completed.

13. The method of claim 5, further comprising:

changing a target revolutions per minute (RPM) of the compressor or a target RPM of the fan motor in response to the operation course of the first clothes treating apparatus and the operation course of the second clothes treating apparatus having the same priority.

14. The method of claim 5, further comprising:

obtaining a revolutions per minute (RPM) of the drum motor corresponding to the operation course of the first clothes treating apparatus;

changing, while the operation course of the first clothes treating apparatus and the operation course of the second clothes treating apparatus having the same priority, a target revolutions per minute (RPM) of the compressor or a target RPM of the fan motor according to the obtained RPM of the drum motor being greater than a preset value; and changing, while the operation course of the first clothes treating apparatus and the operation course of the second clothes treating apparatus having the same priority, a target RPM of the drum motor according to the obtained RPM of the drum motor being smaller than the preset value.

15. A clothes treating system comprising:

a first clothes treating apparatus including:

a drum, a drum motor configured to rotate the drum, and a first controller configured to control the drum motor;

a second clothes treating apparatus including:

a fan, a fan motor configured to rotate the fan, a compressor, and a second controller configured to control the fan motor and the compressor; and a user interface device configured to receive a user input selecting an operation course of the first clothes treating apparatus and an operation course of the second clothes treating apparatus, wherein the first controller is configured to change an algorithm of the operation course of the first clothes treating apparatus based on a priority between the operation course of the first clothes treating apparatus and the operation course of the second clothes treating apparatus, and the second controller is configured to change an algorithm of the operation course of the second clothes treating apparatus based on the priority between the operation course of the first clothes treating apparatus and the operation course of the second clothes treating apparatus.

* * * * *